United States Patent [19]

Tavel

[11] 4,250,789

[45] Feb. 17, 1981

[54] MUSIC SYNTHESIZER

[76] Inventor: Donald L. Tavel, 233 W. Westfield Blvd., Indianapolis, Ind. 46208

[21] Appl. No.: 46,205

[22] Filed: Jun. 7, 1979

[51] Int. Cl.[3] ..... G10H 1/02; G10H 1/08; G10H 5/00

[52] U.S. Cl. ..... 84/1.22; 84/1.24; 331/2; 331/47; 331/56

[58] Field of Search ..... 84/1.01, 1.24, 1.25, 84/1.22; 331/2, 47, 56

[56] References Cited

U.S. PATENT DOCUMENTS

| | | | |
|---|---|---|---|
| 3,800,060 | 3/1974 | Hallman, Jr. | 84/1.24 |
| 3,911,776 | 10/1975 | Beigel | 84/1.24 X |
| 3,999,456 | 12/1976 | Tsunoo et al. | 84/1.01 |
| 4,038,897 | 8/1977 | Murray et al. | 84/1.01 X |
| 4,173,164 | 11/1979 | Adachi et al. | 84/1.24 X |

*Primary Examiner*—Stanley J. Witkowski

[57] ABSTRACT

There is disclosed herein a music synthesizer which responds to a music note played by a music instrument. The synthesizer has an envelope generator which generates a control signal in relation to the input signal to control the loudness of the synthesized note. Also, the synthesizer has a pair of voltage controlled oscillators, one of which provides a signal having a frequency related to the frequency of the input note, and the other of which provides a signal having a frequency related to the frequency of the input signal offset by the ratio of the difference between a programmed note and a referenced note, such as A440. The programmed note is that note following the operation of a control switch. The synthesizer further includes a series of footpads which control various functions of the synthesizer, such as programming the programmed note, to allow the user to control the synthesized sound while playing an instrument. The synthesizer also includes a timbral image modulator which can be selected to provide one of eight different waveshapes to control the cutoff frequency of a voltage controlled filter that filters the two oscillator signals in order to control the timbre of the synthesized signal. The synthesized sound is obtained by amplifying the filter output signal by a gain determined by the envelope generator signal.

19 Claims, 19 Drawing Figures

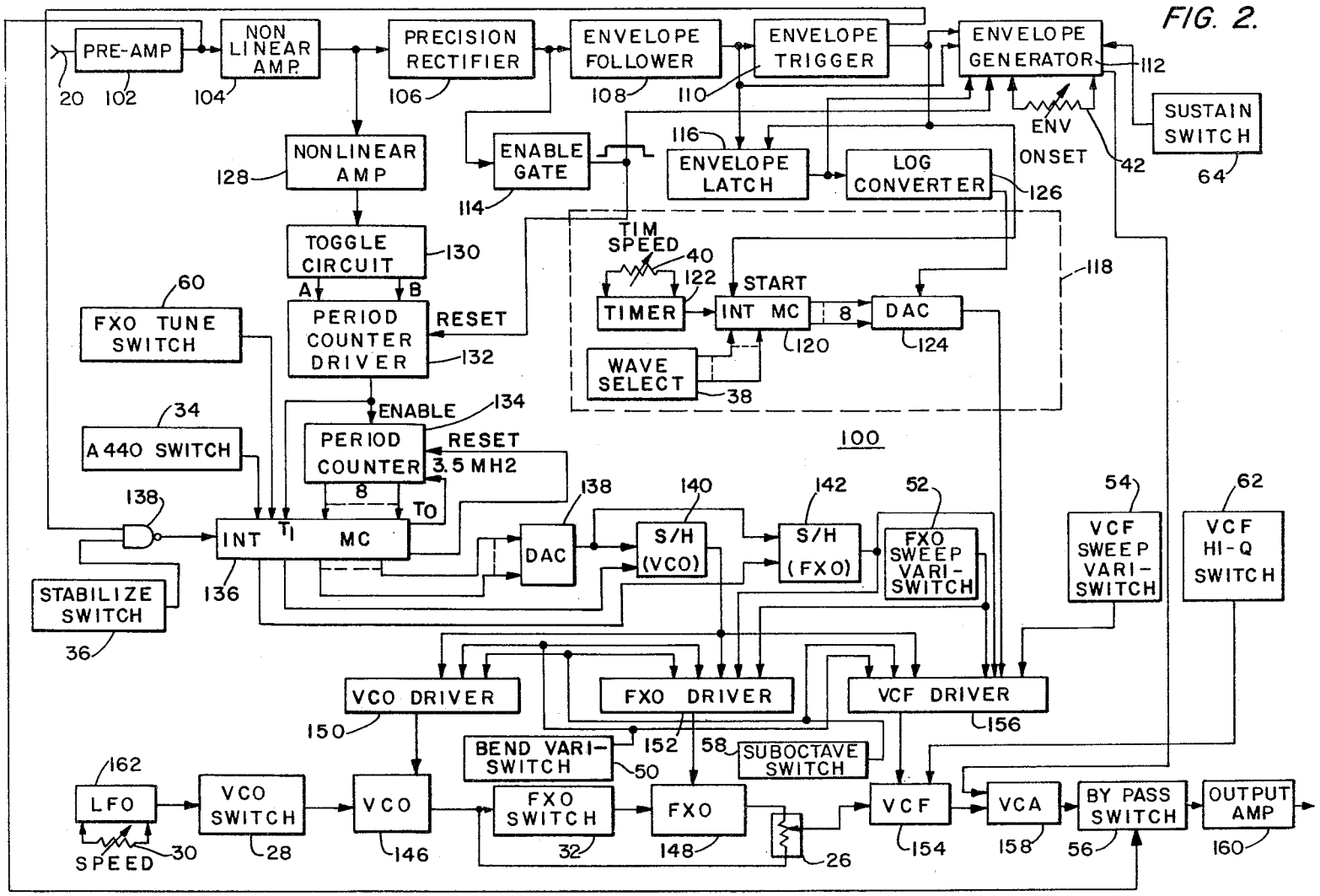
FIG. 2.
SUSTAIN SWITCH
64
112
42
ENVELOPE GENERATOR
ENV
ONSET
126
LOG CONVERTER
118
DAC
124
ENVELOPE TRIGGER
110
ENVELOPE LATCH
116
START
INT MC
8
120
38
TIM SPEED
40
122
TIMER
WAVE SELECT
ENVELOPE FOLLOWER
108
ENABLE GATE
114
PRECISION RECTIFIER
106
NONLINEAR AMP
128
TOGGLE CIRCUIT
130
A
B
RESET
PERIOD COUNTER DRIVER
132
ENABLE
134
RESET
3.5 MHZ
PERIOD COUNTER
8
TO
MC
T1
INT
136
NON LINEAR AMP.
104
PRE-AMP
102
20
60
FXO TUNE SWITCH
34
A440 SWITCH
138
STABILIZE SWITCH
36
100
VCF HI-Q SWITCH
62
VCF SWEEP VARI-SWITCH
54
FXO SWEEP VARI-SWITCH
52
S/H (FXO)
142
S/H (VCO)
140
DAC
138
VCF DRIVER
156
FXO DRIVER
152
VCO DRIVER
150
SUBOCTAVE SWITCH
58
BEND VARI-SWITCH
50
FXO SWITCH
32
FXO
148
VCO
146
VCO SWITCH
28
LFO
162
SPEED
30
VCF
154
VCA
158
BY PASS SWITCH
56
OUTPUT AMP
160
26

PREAMPLIFIER
NONLINEAR AMPLIFIER
FULL WAVE RECTIFIER
ENVELOPE FOLLOWER
ENVELOPE GATE
PERIOD COUNTER DRIVER
TOGGLE CIRCUIT
NONLINEAR AMPLIFIER

SUSTAIN SWITCH
ENVELOPE GENERATOR
ENVELOPE TRIGGER
LOG CONVERTER
ENVELOPE LATCH
SW
+V
+Vo

| MEMORY ADDER | TABLE ADDER |
|---|---|
| F0 | 70 |
| F1 | 75 |
| F2 | 7A |
| F3 | 81 |
| F4 | 90 |
| F5 | 9F |
| F6 | BA |
| F7 | CF |

| TABLE ADDER | TABLE CODE |
|---|---|
| 70 | 01 |
| 71 | FF |
| 72 | 9F |
| 73 | FF |
| 74 | 00 |

FIG. 7A.
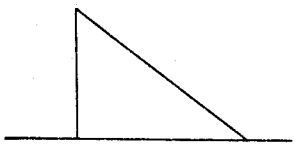
FIG. 7B.
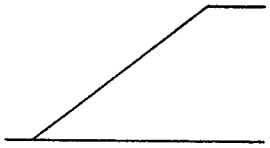
FIG. 7C.
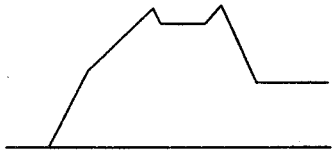
FIG. 7D.
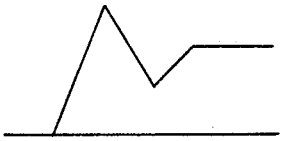
FIG. 7E.
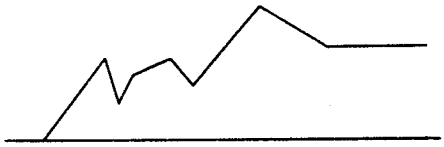
FIG. 7F.
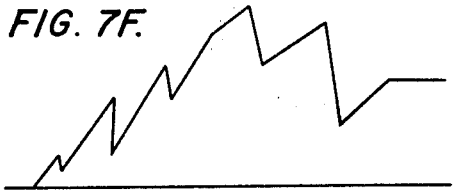
FIG. 7G.
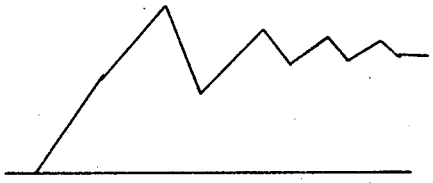
FIG. 7H.
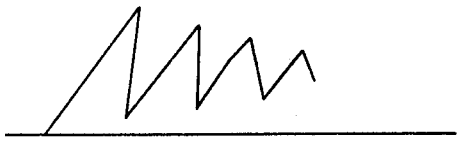
FIG. 4.
| | |
|---|---|
| FIG. 4A. | FIG. 4B. |
| FIG. 4C. | FIG. 4D. |
| FIG. 4E. | FIG. 4F. |

MUSIC SYNTHESIZER

This invention relates to a music synthesizer and more particularly to a music synthesizer which responds to an input signal from a musical instrument and provides a synthesized version of that musical signal.

Music synthesizers have been commercially available for approximately the last decade and generally consist of a keyboard input such as a piano or organ would have. The prior art synthesizers respond to the depression of one of the keys by providing a signal having a fundamental frequency associated with only that key. Many various controls are also provided on the prior art synthesizers which are used to control the envelope and filtering characteristics of the signal provided in response to the key depression. In order to fully obtain all of the musical effects of the prior art synthesizer, a very skillful operator is required. The operator not only must have music training and be able to perform on a keyboard instrument, but also must be able to understand and control all of the many control panel functions provided.

One of the failings of the prior art synthesizers with keyboard input is that the output signal cannot be dynamically controlled in response to an input signal. For instance, the output signal of the keyboard synthesizer does not change in loudness whether the key is struck softly or with vigorous force. Also, the utilization of the synthesizers is limited to those having the ability to play keyboard instruments. Thus, a person playing a guitar or a trumpet could not use a music synthesizer of the prior art to generate sound associated with his own instrument.

This is not to say that there is no teaching in the prior art to provide a musical signal from an instrument to a device which synthesizes a sound in response to that instrument. For instance, in U.S. Pat. No. 4,038,897 entitled "Electronic Music System and Stringed Instrument Input Device Therefor" in the name of Jeffrey J. Murray et al., a guitar is associated with a synthesizer. However, the control signals connected to the synthesizer are a series of voltages which relate to the actual note played on the guitar and are derived by forming a matrix of the strings and the frets so that the depression of a particular string on a particular fret causes a voltage peculiar to that depression to be applied to the device. Again, in this patent there is no unique response to the manner in which the player plays a musical note.

In U.S. Pat. No. 3,999,456 entitled "Voice Keying System For A Voice Controlled Musical Instrument" in the name of Masahiko Tsunoo et al., a system is described which responds to a musical signal from a microphone such as a voice signal or a signal from an instrument. The device provides a control signal in response to the musical input which represents a plurality of different predetermined frequency bands. The system in this patent does not actually respond to each individual input note played and is not controllable in response to the actual note played.

In U.S. Pat. No. 3,911,776 entitled "Sound Effects Generator" in the name of Michael L. Beigel, a system is described in which a musical sound, such as from a guitar, is provided through a voltage controlled filter which has a cut-off frequency controlled in response to the envelope magnitude of the input signal. While this patent does allow some control by the manner in which the operator plays the note, it is very limited in the amount of synthesizing which can be done. It only controls the actual note played rather than synthesizing a new sound in response to the note played.

A music synthesizer is the type of instrument which allows many different types of sounds to be obtained which conventional instruments are unable to produce. Some of the differences are due to the ability to modulate the synthesized signal in different manners. It has been found that one desirable type of modulation is given the name of complex modulation and utilizes a first voltage controlled oscillator providing signals having a frequency equivalent to the frequency of an input signal and a second voltage controlled oscillator which provides a signal having a frequency a fixed ratio away from the frequency provided by the first oscillator. Complex modulation occurs by obtaining a triangle wave at the frequency X of the first oscillator signal and applying it to frequency modulate the second oscillator signal. This produces side bands at different places to create overtones.

In accordance with one preferred embodiment of this invention, there is provided an improved music synthesizer having means for generating a first voltage manifesting the frequency of an input signal, a first voltage controlled oscillator means for responding to the first voltage by providing the signal having a first frequency related to a first voltage. The improvement comprises second voltage controlled oscillator which responds to a second voltage applied thereto for providing a signal having a second frequency related to the second voltage. The second voltage is related to the first voltage less a programmed voltage. In addition the synthesizer comprises means for connecting a modulating signal having the first frequency to the second voltage controlled oscillator means, to frequency modulate the second voltage controlled oscillator signal.

A detailed description of one preferred embodiment of this invention will now be given with specific reference being made to the following FIGURES, in which:

FIG. 2 is a block diagram of the frequency synthesizer shown in FIG. 1;

FIG. 4 shows how

FIGS. 7A–7H show the eight waveforms provided by the timbral image modulator.

Figure 1:
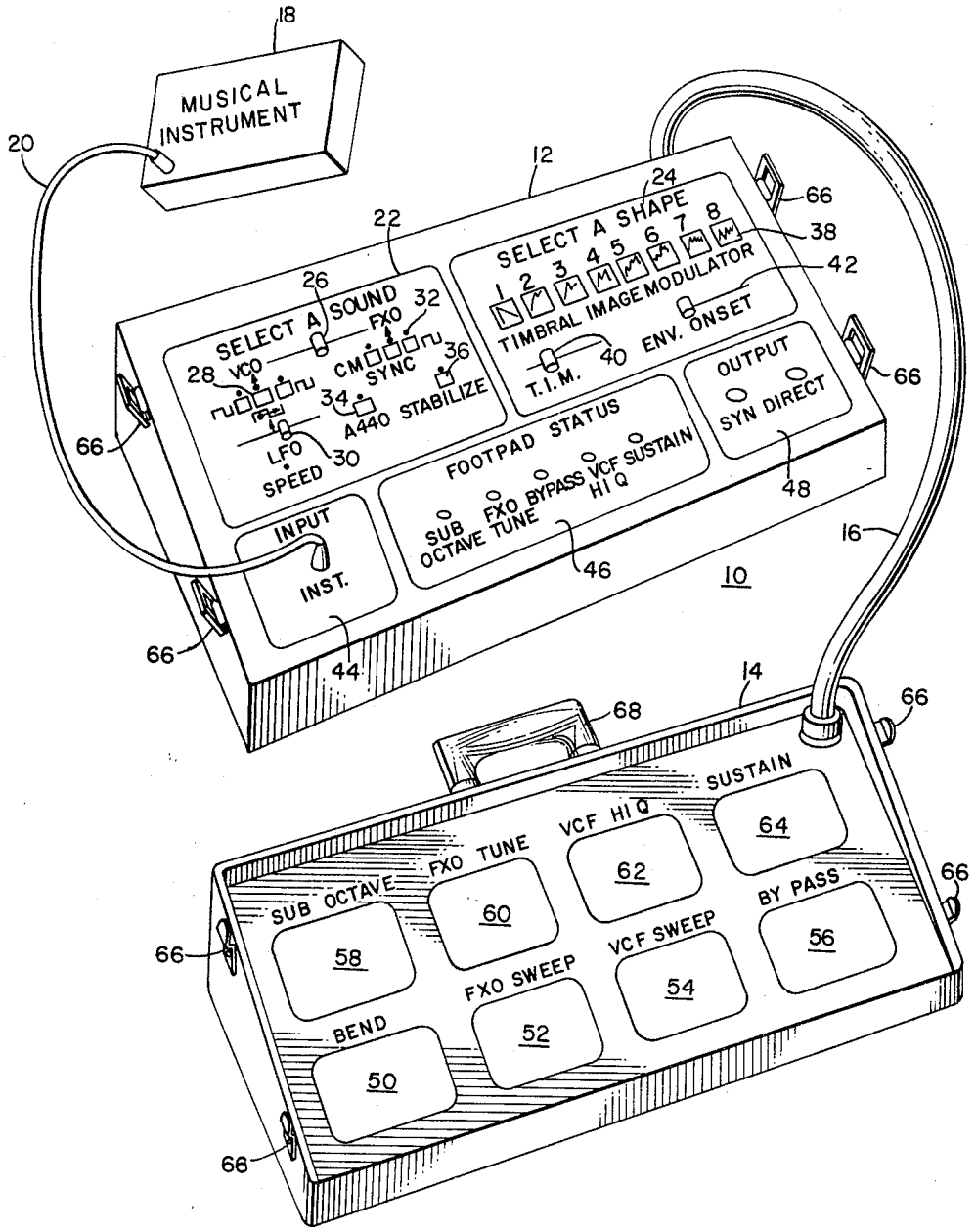
FIG. 1 shows the frequency synthesizer of the subject invention.

Referring now to FIG. 1, the frequency synthesizer 10 of the subject invention is shown. Synthesizer 10 includes a control panel 12 and a footpad 14 interconnected by wires 16. The input signal to control panel 12 is an electrical signal derived from a musical instrument 18 such as a guitar and applied to control panel 12 through wire 20. The output of synthesizer 12 may be applied as an electric signal to a set of speakers (not shown) or any other conventional sound system.

Control panel 12 includes two primary sections-the select a sound section 22 and the select a shape section 24. Each of these sections contain a series of push buttons or potentiometer control levers which can cause various functions to occur. In select a sound section 22, potentiometer 26 lever controls the mix between two frequency signals provided from two oscillators which will be discussed in detail hereafter. These oscillators are both voltage controlled oscillators and are respectively called the VCO and the FXO. The VCO is used to provide the basic synthesizer frequency sound and the FXO is utilized to provide special effects sounds. Three position VCO switch 28 and low frequency oscillator speed potentiometer 30 are utilized together to control the pulse width modulation of the VCO oscillator. When VCO switch 28 is depressed in its right position, a voltage which causes a square wave output is provided to the pulse width modulation input of the VCO. When VCO switch 28 is in its left position, a voltage which causes a pulse wave at the VCO output is applied to the pulse width modulation input of the VCO. When VCO switch 28 is in the center position, the setting of the lever of potentiometer 30 controls the frequency of a triangle wave applied to the pulse width modulation input of the VCO.

Three position FXO switch 32 controls the dependence of the FXO signal upon the VCO signal. When FXO switch 32 is in the right position, the FXO oscillator is neither synchronized to nor modulated by the VCO oscillator. When the FXO switch 32 is in the center position, the FXO oscillator is in phase synchronization (sync) with the VCO oscillator, or in other words the FXO oscillator is locked to a multiple of the frequency of the VCO oscillator. This creates certain harmonic effects in which the FXO programmed note becomes an emphasized harmonic overtone. When FXO switch 32 is in the left position, a phenomenon known as complex modulation (CM) occurs. This is caused by a triangle wave having a frequency equal to the VCO oscillator frequency being applied to a frequency modulation input of the FXO oscillator. This allows the user of synthesizer 10 to turn musical notes into many different sounds. Complex modulation utilizes a carrier frequency, which is the FXO oscillator frequency, which is modulated by the VCO oscillator frequency, to produce sidebands at multiples of the modulator with the carrier as the Nth harmonic.

Select a sound section 22 includes two additional switches, A440 switch 34 and stabilized switch 36. Depression of A440 switch 34 causes synthesizer 10 to produce the note A440. This can be used to tune other instruments to an electrically determined and accurate note of A440. Normally A440 switch 34 is in the off position during the utilization of synthesizer 10.

Stabilized switch 36 is used to prevent any sudden changes in the middle of a note. It has been determined that any change greater than ½ of an octave is likely to be noise rather than effects created by the person using music instrument 18. Thus, when stabilized switch 36 is in the enabled position, all variations during the middle of a note greater than plus or minus ½ an octave are ignored.

Select a shape section 24 involves the controlling of a timbral image modulator which causes one of eight selected unique waveshapes to be provided to control the sound of the synthesized signal produced by synthesizer 10. Select a shape section 24 includes eight push buttons 38, only one of which at a given time can be depressed. The particular button 38 depressed determines which one of the various timbral image modulator waveshapes is provided. In addition, select a shape section 24 includes a timbral image modulator speed control potentiometer 40 lever which controls the duration of the waveshape selected by the depressed one of the buttons 38. Finally, select a shape section 24 includes an envelope onset potentiometer 42 lever that determines the attack time of the envelope signal, which is derived from the music input signal provided from music instrument 18.

Control panel 12 also includes an input jack 44 into which wire 20 from music instrument 18 is plugged. In addition, control panel 12 includes five light emitting diodes (LED) which indicate the status of the footpads contained in footpad panel 14. Whenever a switch footpad is in the ON state, the appropriate LED in the status lights 46 is illuminated. Finally, control panel 12 includes output jacks 48 which are the synthesizer output and a direct output. The direct output is coupled directly to input jack 44 and provides the actual signal played by music instrument 18 whereas the synthesizer output provides the synthesized signal played in response to the signal from music instrument 18.

Referring now to footpad 14, eight different footpads are shown, five of which are switches controllable by the foot and three of which are varipads which provide a variable voltage to control panel 12 in response to the force of the foot on the pad. The three varipads are bend varipad 50, FXO sweep varipad 52 and VCF sweep varipad 54. Each of these varipads are constructed of a material known as Dynacon, which is a type of resistive material which conducts generally in the horizontal direction with the amount of resistance decreasing in response to the compression applied thereto. This, in turn, can cause the voltage provided by the varipad to increase in response to the foot compression.

Bend varipad 50 is used to cause the control voltage applied to the VCO oscillator and the FXO oscillator to increase in response to the amount of pressure placed on footpad 50. This, in turn, causes the frequency of those oscillators to increase. Also, the cut-off frequency of the voltage controlled filter is sweeped by bend varipad 50. FXO sweep varipad 52 is similar to bend varipad 50 except it is not applied to the VCO oscillator and can cause the signal provided by FXO oscillator to vary in response to the force applied to varipad 52. VCF sweep varipad 54 causes the voltage applied to the voltage control filter to vary by changing the cut-off frequency of the low pass voltage control filter.

The switch pads include bypass switch pad 56, suboctave switch pad 58, FXO tune switch pad 60, VCF Hi Q switch pad 62 and sustain switch pad 64. Bypass switch pad 56, when depressed, causes the output signal at the synthesizer output 48 to be the same as the signal applied to input 44. When depressed again, bypass switch pad 56 allows the synthesized signal to be provided at the synthesizer output 48. Thus, bypass switch pad 56 has a latching circuit associated therewith which causes a function change to occur and remain changed in response to each depression of the pad. Suboctave switch pad 58, which also has a latching circuit associated therewith, is used to cause the VCO and FXO oscillators to provide signals one octave lower than the signal provided from music instrument 18. FXO tune switch pad 60, which does not have a latch circuit associated therewith, is depressed and a note played on music instrument 18 causes the reprogramming of synthesizer 10 by causing the frequency provided by FXO oscillator to change. VCF Hi-Q switch pad 62, which has a latch circuit associated therewith, is provided to cause the feedback associated with the voltage control filter to increase, whereby a nasal sound is associated with the sound produced by synthesizer 10. This is accomplished by creating a peak in the filter's response around its cut-off frequency. Sustain switch pad 64, which also has a latch circuit associated therewith, is used to cause the sound of each note to remain at a constant magnitude rather than naturally decaying, as would be the case where a percussion instrument such as a guitar is instrument 18.

The shape of control panel 12 and footpad panel 14 are such that all the controls and all of the footpads are placed on a slight incline to the horizontal position upon which each of these panels may be placed. The front, back, and two sides of each of control panel 12 and footpad panel 14 form a rectangular configuration with the bottom of each being on the horizontal plane and generally perpendicular to the front, back and sides. Normally, control panel 12 is placed on a table and footpad panel 14 on the floor. The incline of each is selected to be the same, so that they may be placed together with the footpads facing the controls in such a manner as to form a generally rectangular shaped configuration, sometimes known as a parallelipied. The two panels may be locked together by locks 66, which may be similar to the locks found on a conventional suitcase, and the combined panels may be carried by handle 68 which has been shown placed on the footpad section 14.

All of the circuitry necessary for the operation of the synthesizer is contained within control panel 12 or footpad panel 14.

Figure 3:
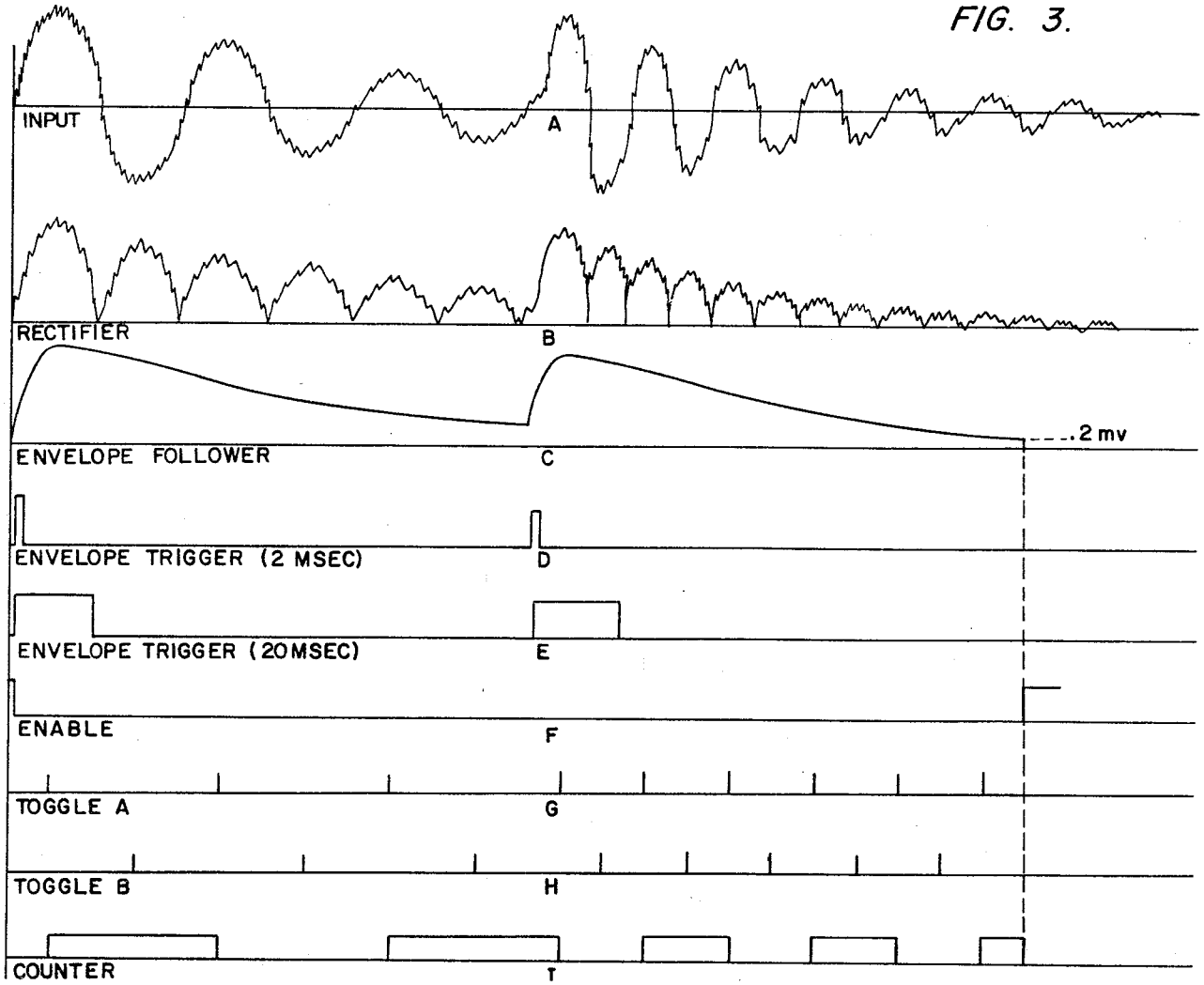
FIG. 3 is a series of waveforms useful in understanding the operation of the frequency synethesizer shown in FIG. 2.

Referring now to FIGS. 2 and 3, a block diagram of synthesizer circuit 100 will be discussed. Circuit 100 includes pre-amplifier 102 to which the input signal from music instrument 18 is applied and amplified. The input signal is shown as waveform A in FIG. 3. The output of pre-amplifier 102 is provided to non-linear amplifier 104 which amplifies the signal provided thereto such that the lower the signal magnitude, the more the amplification. This allows synthesizer 10 to respond to very low input signals. The output from non-linear amplifier 104 is provided through precision rectifier 106 which takes the generally bipolar music signal and rectifies it so that the output of the precision rectifier 106 is a positive signal at all times. Precision rectifier 106 is a full wave rectifier so that the negative portion of the input signal are merely inverted to the positive amplitude side. The output signal from precision rectifier 106 is shown as B in FIG. 3. The output from precision rectifier 106 is applied to envelope follower 108 which provides a unipolar signal of the envelope of the output from precision rectifier 106. Envelope follower 108 may be a precision low-pass filter. The output signal from envelope follower 108 is shown as waveform C in FIG. 3. The envelope signal from envelope follower 108 is provided to envelope trigger 110 which provides two signals at the beginning of each new note as manifested by a new envelope signal. The upper output signal provided from envelope trigger 110 is twenty milliseconds in duration and is shown as waveform E in FIG. 3. The lower output signal is two milliseconds in duration and is shown as waveform D in FIG. 3. Each of the two signals has a leading edge occurring at the same time, which is very shortly after the occurrence of a new note provided from music instrument 18. The lower output from envelope trigger circuit 110 is provided to envelope generator 112 which includes potentiometer 42, shown in FIG. 1.

The output from precision rectifier 106 is also provided to enable gate 114 which provides a zero volt signal as long as each pulse from precision rectifier 106 has a maximum amplitude above a certain value. The enable gate 114 signal becomes zero volts when pulse signal amplitude exceeds 0.6 volts initially and remains at logic zero as long as the amplitude of each pulse from precision rectifier 106 remains above 0.2 of a millivolt. The enable gate output signal is shown as waveform F in FIG. 3. The output from enable gate 114 is provided to envelope generator 112.

The output from envelope follower 108 is also provided to the input of envelope latch 116. In addition, the lower or two millisecond signal from envelope trigger 110 is provided to reset envelope latch 116 at the beginning of each new note. Envelope latch 116 provides a signal at its output which manifests the maximum attained amplitude of the envelope signal provided from envelope follower 108. Thus, the output from envelope latch 116 increases with the envelope signal from envelope follower 108, until such time as the maximum amplitude is reached. Thereafter, the output from envelope latch 116 is a steady state signal having an amplitude equal to the maximum attained amplitude of the envelope. The output of envelope latch 116 is provided to envelope generator 112.

In addition to the other signals previously mentioned applied to envelope generator 112, the envelope follower 108 signal and a signal from sustain switch 64 on foot control panel 12 is also applied. The purpose of envelope generator 112 is to provide the synthesizer envelope signal which ultimately controls the gain by which the output of the voltage controlled filter is amplified to provide synthesizer output signal. The envelope generator 112 signal is a signal which rises to the maximum value of the envelope follower 108 signal. The time for the envelope generator 112 signal to rise to this maximum value is controllable by adjusting potentiometer 42. Thus, the attack time of the envelope is controllable from control panel 12 by the lever arm of potentiometer 42. As long as sustain switch 64 is not enabled, the envelope generator 112 signal will begin falling at a rate determined by the envelope follower 108 signal. Envelope generator 112 will provide its signal so long as the enabled gate 114 signal is zero volts. When sustain switch 64 is enabled, the signal provided from envelope generator 112 rises to the maximum value of the envelope follower 108 signal as previously described. However, it will thereafter remain at that maximum value until such time as the enable gate 114 signal ceases to be zero volts or until a new note is played by instrument 18 to cause a new envelope follower 108 signal and envelope latch 116 signal to occur.

Timbral image modulator 118 forms the basic component of the select a shape section 24 and is used to provide a selected waveshape signal to the voltage control filter to control the cut-off frequency at which the filter operates. Timbral image modulator 118 consists primarily of microprocessor 120 which may be an Intel 8048 microprocessor. Timer 122 provides a square wave input signal to interrupt microprocessor 120 at a frequency controlled by the setting of potentiometer 40. In addition, signals from the eight switches 38 contained in wave select circuit 38 are provided as inputs to port one of microprocessor 120. The envelope trigger two millisecond signal from envelope trigger 110 is provided to start the operation of one cycle of microprocessor 120. In response to one switch 38 signal and the speed at which timer 122 provides pulses, an eight bit digital signal is provided at the eight outputs of microprocessor 120 to digital to analog converter (DAC) 124. Digital to analog converter 124 is a multiplying type converter which multiplies the digital value applied thereto by a factor determined by the voltage value applied to the multiplying input and provides an analog voltage signal at its output equal to the multiplied digital signal. The envelope latch 116 signal is provided to log converter 126 which provides a signal equal to the logarithm of the envelope latch 116 signal. The log converter 126 signal is provided to the multiplying input of digital to analog converter 124. The eight timbral image modulator 118 waveshapes are shown in FIGS. 7A–7H.

The output from non-linear amplifier 104 is provided to a second non-linear amplifier 128 which amplifies the lower amplitude signal with more gain than the higher amplitude signals applied thereto. The output from non-linear amplifier 128 is provided to toggle circuit 130 which provides two signals shown as waves G and H in FIG. 3. The toggle A signal is provided each time a positive peak voltage occurs in a cycle of the input signal and the toggle B signal is provided each time a negative peak signal occurs in a cycle of the input signal. Both the toggle A and toggle B signals are 180 degrees out of phase with each other and occur at a frequency equal to the frequency of the input signal.

The toggle A and toggle B signals are provided to period counter driver 132 which also has applied thereto the enable gate 114 signal as an enabling signal. Period counter driver 132 is enabled by the enable gate 114 signal and provides a square wave pulse signal having a frequency equal to one-half the frequency of the input signal. The output from period counter driver 132 is provided to enable period counter 134. Period counter 134 also has a reset signal and a clock signal applied thereto from microprocessor 136. Period counter 134 is reset by microprocessor 136 each time a new cycle of the period counter driver square wave signal occurs. The period counter 134 output signal is shown as waveform I in FIG. 3. Thereafter, period counter 134 counts the number of clock pulses applied thereto from microprocessor 136 during the positive half cycle of the period counter driver square wave signal. When period counter 134 reaches a full count, microprocessor 136 increments a register therein and period counter 134 overflows back to zero. When the positive half cycle of the period counter driver 132 signal is over, microprocessor 136 reads the count in period counter 134 and together with the incremented register microprocessor 136 contains a count equal to the time between cycles of the input signal.

Microprocessor 136, which may also be an Intel 8048 microprocessor, in addition to the eight outputs from period counter 134, has applied thereto signals from FXO tune switch 60, A-440 switch signal 34 and a signal from NAND gate 138. NAND gate has applied thereto the twenty millisecond signal from envelope trigger 110 and a signal from stabilized switch 36. Whenever stabilized switch 136 is on, a high voltage signal is applied to the interrupt input of microprocessor 136, except during the twenty millisecond time period of the envelope trigger 110 signal when a low voltage signal is applied. If stabilized switch 36 is off, then a high voltage signal is always applied to the interrupt input of microprocessor 136.

Microprocessor 136 provides an eleven bit digital signal to digital to analog converter (DAC) 138 which converts the digital signal into an analog voltage. This voltage is applied to sample and hold (S/H) circuits 140 and 142, each of which are enabled to sample and hold the voltage by appropriate enabling signals applied from microprocessor 136. The digital signal provided by microprocessor 136 in response to one cycle of the input signal represents the frequency of the input signal. Microprocessor 136 computes the frequency after reading count of period counter 134 by determining the time between cycles and using that time together with a one over X table look up procedure to convert the time to frequency. Each time a new cycle is analyzed, a digital signal is applied through digital to analog converter 138 and sample and hold circuit 140 is enabled to provide the proper voltage relating to the frequency of the input signal.

When FXO tune switch 60 is depressed, it is desired to store a signal in microprocessor 136 relating to the note immediately following the switch depression. Thereafter, a digital signal is provided through digital to analog converter 138 to sample and hold circuit 140 in the manner just described. In addition, a value relating to the frequency of the note played is stored in microprocessor 136. A digital signal is provided through digital to analog converter 138 to sample and hold circuit 142 each time a cycle of the input signal is processed by microprocessor 136, regardless of the frequency of input signal at that time. Thus, for each cycle of the input signal, sample and hold circuit 140 provides a voltage related to the frequency of the note then played and sample and hold circuit 142 provides a voltage equivalent to the note played following the most recent closure of the FXO tune switch 60.

The basic pitch of the synthesizer 10 sound is provided by a pair of oscillators, each of which are voltage controlled oscillators. The first of these oscillators is VCO oscillator 146 and it is the primary oscillator for providing a frequency related to the input signal. The second oscillator is FXO oscillator 148 and it provides a frequency offset from the frequency of VCO 146 by a certain frequency interval. Each of VCO oscillator 146 and FXO oscillator 148 have associated therewith respective VCO driver circuit 150 and FXO driver circuit 152. The output of VCO 146 and FXO 148 are mixed together through potentiometer 26, the handle of which is shown as lever 26 in FIG. 1. The center tap of potentiometer 26 is provided to voltage control filter (VCF) 154. Voltage control filter 154 also has a driver circuit 156 associated therewith. The output of voltage control filter 154 is provided as the input signal to voltage controlled amplifier 158. The output from envelope generator 112 is provided to control the gain of voltage controlled amplifier (VCA) 158. The output of voltage controlled amplifier 158 and the output of pre-amp 102 are applied to by-pass switch circuit 56, which passes one of the applied signals thereto to output amplifier 160.

VCO oscillator 146 has the output of VCO switch 28 applied to its pulse width modulation input. VCO switch 28 provides one of three types of signals depending upon the setting of switch 28. In the square wave position of switch 28 a voltage is applied causing the output pulses of VCO oscillator 146 to have a 50% duty cycle. When the setting of VCO switch 28 is in the pulse position, a voltage is applied that causes the output pulses of VCO oscillator 146 to have a 30% duty cycle. If VCO switch 28 is set in the LFO position, then the output from low frequency oscillator 162 is provided to the pulse width modulation input of VCO oscillator 146. Low frequency oscillator 162 provides a triangle wave having a frequency determined by the setting of resistor 30, of which handle 30 is shown in FIG. 1. The frequency of the triangle wave provided by low frequency oscillator 162 may vary from approximately 1 hertz to approximately 20 hertz, depending upon the setting of resistor 30.

VCO driver 150 provides a control voltage to VCO oscillator 146 to determine the frequency at switch VCO 146 provides its output signal. The output of sample and hold circuit 140 is the primary input to VCO driver 150. In addition, voltages are provided to driver circuit 150 from the bend varipad 50 and suboctave switch 58 to modify the primary voltage from sample and hold circuit 146.

FXO 148 responds to the voltage provided to it from FXO driver 152 to control its primary oscillating frequency. FXO driver 152 has applied thereto to the outputs of sample and hold circuits 140 and 142 and in response thereto provides a voltage to cause FXO oscillator 148 to provide a pulse signal having a frequency equal to the frequency of the input signal less the difference between the programmed note frequency and the frequency of the note A440. In addition, the output signals from the FXO sweep varipad 52, the bend varipad 50 and suboctave switch 58 are applied to FXO driver 152 to control the voltage applied to FXO oscillator 148.

In addition to the control voltage, FXO oscillator can have voltages provided in response to the VCO frequency applied to either a phase synchronization input or an FM modulation input thereof, depending on the setting of FXO switch 32. If FXO switch 32 is in a square wave position, then both the phase synchronization and frequency modulation inputs of FXO 148 are grounded. If FXO switch 32 is in the sync position, then the pulse wave at the output of the VCO oscillator 146 is applied to the FXO oscillator 148 phase synchronization input, and if FXO switch 32 is in the CM, or complex modulation position, then a triangle wave having a frequency equal to the frequency of the VCO oscillator 146 signal is applied to the frequency modulation input of FXO 148.

The signal combined by potentiometer 26 from VCO oscillator 146 and FXO oscillator 148 is applied through voltage controlled filter 154, which is a low pass filter having a controllable cut-off frequency. The cut-off frequency of voltage control filter 154 is determined by the voltage applied thereto from VCF driver 156. VCF driver 156 has applied thereto as its primary input, the voltage from digital to analog converter 124, which is the timbral image modulator 118 selected wave. In addition, voltages from the VCF sweep varipad 54, sample and hold circuits 140 and 142, FXO sweep varipad 54, suboctave switch 58 and bend varipad are applied to VCF driver 156. Each of these applied voltages control the output voltage provided by VCF driver 156, although the principal controlling voltage is the timbral image modulator voltage applied from the output of digital analog converter 124.

Voltage control filter 154 is also controllable by the VCF Hi-Q switch 62 to vary the amount of feedback associated therewith. When VCF Hi-Q switch is in the off position a small amount of feedback occurs in voltage control filter 154 and when VCF Hi-Q switch is in the on position, a substantial amount of the output voltage is fed back to the input of voltage control filter 154 causing a nasal sound to be associated with the signal provided by synthesizer 10. The large feedback voltage causes a knee to occur around the cut-off frequency of voltage control filter 156 and more of the higher frequencies around the cut-off frequency are passed through voltage control filter 154 than other frequencies in the low range allowed.

The output of voltage control filter 154 is applied to voltage controlled amplifier 158 which amplifies the frequency signal applied thereto with a gain determined by the output of envelope generator 112.

Figure 4A:
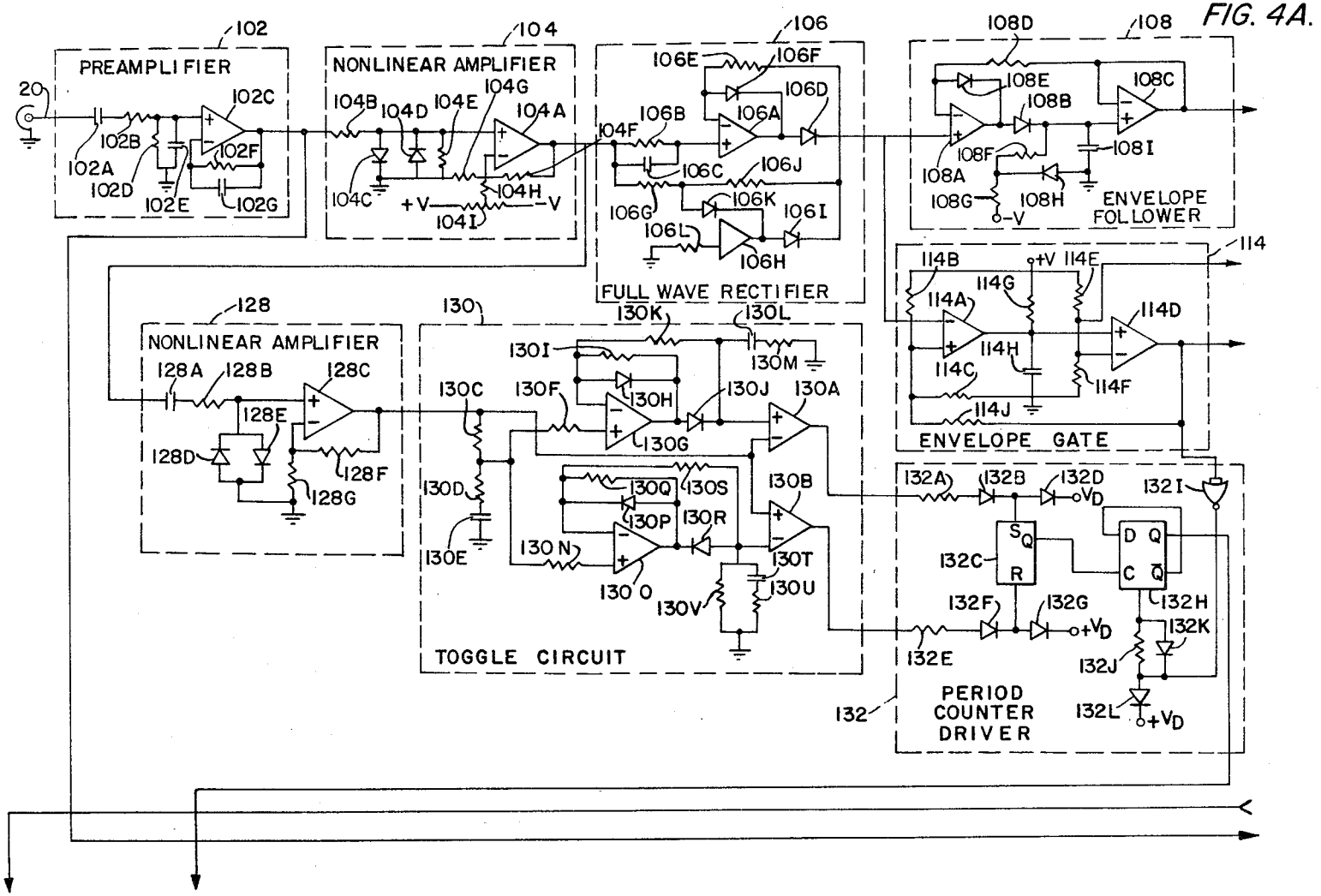
FIGS. 4A through 4F are connected to show a detailed electrical schematic diagram of the block diagram shown in FIG. 2.

Referring now to FIGS. 4A through 4F, connected as shown in FIG. 4 there is shown a detailed circuit diagram of the block diagram shown in FIG. 2. Referring to FIG. 4A, the input signal from music instrument 18 is applied through one lead of cable 20, the other lead being coupled to the system ground. The input signal is applied to preamplifier 102 through capacitor 102A and resistor 102B to the noninverting input of audio amplifier 102C. Connected between the junction of resistor 102B and the noninverting input of amplifier 102C and ground is a parallel connected resistor 102D and capacitor 102E. The output of amplifier 102C is fed back through parallel coupled resistor 102F and capacitor 102G to the inverting input of amplifier 102C. Capacitor 102A is an input capacitor and capacitor 102E is for the purpose of eliminating any radio frequency (RF) interference. Capacitor 102G is a feedback by-pass capacitor and resistor 102B is for input protection and resistor 102D connects the input to ground.

The output from amplifier 102C is coupled to the non-inverting input of semi logarithmic amplifier 104A through serially coupled resistor 104B. Connected between the junction of resistor 104B and the non-inverting input of amplifier 104A are opposite polled matched parallel diodes 104C and 104D, the other ends of which are coupled to ground. Also resistor 104E is coupled between the junction of resistor 104B and the non-inverting input of amplifier 104A and ground. The output of amplifier 104A is coupled through feedback resistor 104F to the inverting input thereof. Resistor 104G which controls the gain is coupled between the inverting input of amplifier 104A and the ground, and resistor 104H is coupled between the inverting input of amplifier 104A and the center tap of potentiometer 104I.

The output from amplifier 104A is applied to the non-inverting input of operational amplifier 106A through parallel connected resistor 106B and capacitor 106C in full wave precision rectifier 106. The output of operational amplifier 106A is applied through the anode cathode path of diode 106D and feedback resistor 106E to the inverting input of amplifier 106A. The output of amplifier 106A is also coupled through the cathode anode path of diode 106F to the inverting input of amplifier 106A.

The output from non-linear amplifier 104 is also applied through resistor 106G to the inverting input of operational amplifier 106H. The output of amplifier 106H is applied through the anode cathode path of diode 106I and feedback resistor 106J to the inverting input of amplifier 106H. The output of amplifier 106H is also fed back through the cathode anode path of diode 106K to the inverting input of amplifier 106H. The non-inverting input of amplifier 106H is coupled through resistor 106L to ground. The cathode of diode 106I is coupled through resistor 106M to ground. The cathodes of diodes 106I and 106D are coupled together to form the rectifier output of rectifier 106. The positive portions of the amplified input signals are applied through the circuit components associated with amplifier 106A and the negative going portions of the amplified input signal are applied to the circuit components associated with amplifier 106H and inverted thereby so that the output at the junction of diodes 106D and 106I is a series of pulses swinging from zero to a positive voltage, each pulse of which constitutes one-half of a cycle of the input signal.

The output from rectifier 106 is taken from the junction of the cathodes of diode 106D and 106I and applied to the non-inverting input of unipolar driver amplifier 108A in envelope follower 108. The output from amplifier 108A is applied through diode 108B to the non-inverting input of high impedance source follower amplifier 108C. The output from amplifier 108C is fed back directly to the inverting input of amplifier 108C and through resistor 108D to the inverting input of amplifier 108A. Diode 108E is coupled with its anode cathode path being between the inverting input and the output of amplifier 108E. The cathode of diode 108B is coupled through serially connected resistors 108F and 108G to a source of negative voltage. The junction between resistors 108F and 108G is coupled between the cathode anode path of diode 108H to ground. Capacitor 108I is coupled between the non-inverting input of amplifier 108C and ground. Connected in this manner, envelope follower 108 operates to provide a voltage following the peak value of each of the pulses from rectifier 106. The maximum voltage applied to envelope follower 108 is stored in capacitor 108I so that the output of amplifier 108C represents the maximum voltage of the alternating voltage input signal, or in other words, the envelope of the input signal. Resistor 108D functions as a stabilizing feedback resistor. Envelope follower 108 is described in more detail in the aforementioned U.S. Pat. No. 3,911,776.

Figure 4B:
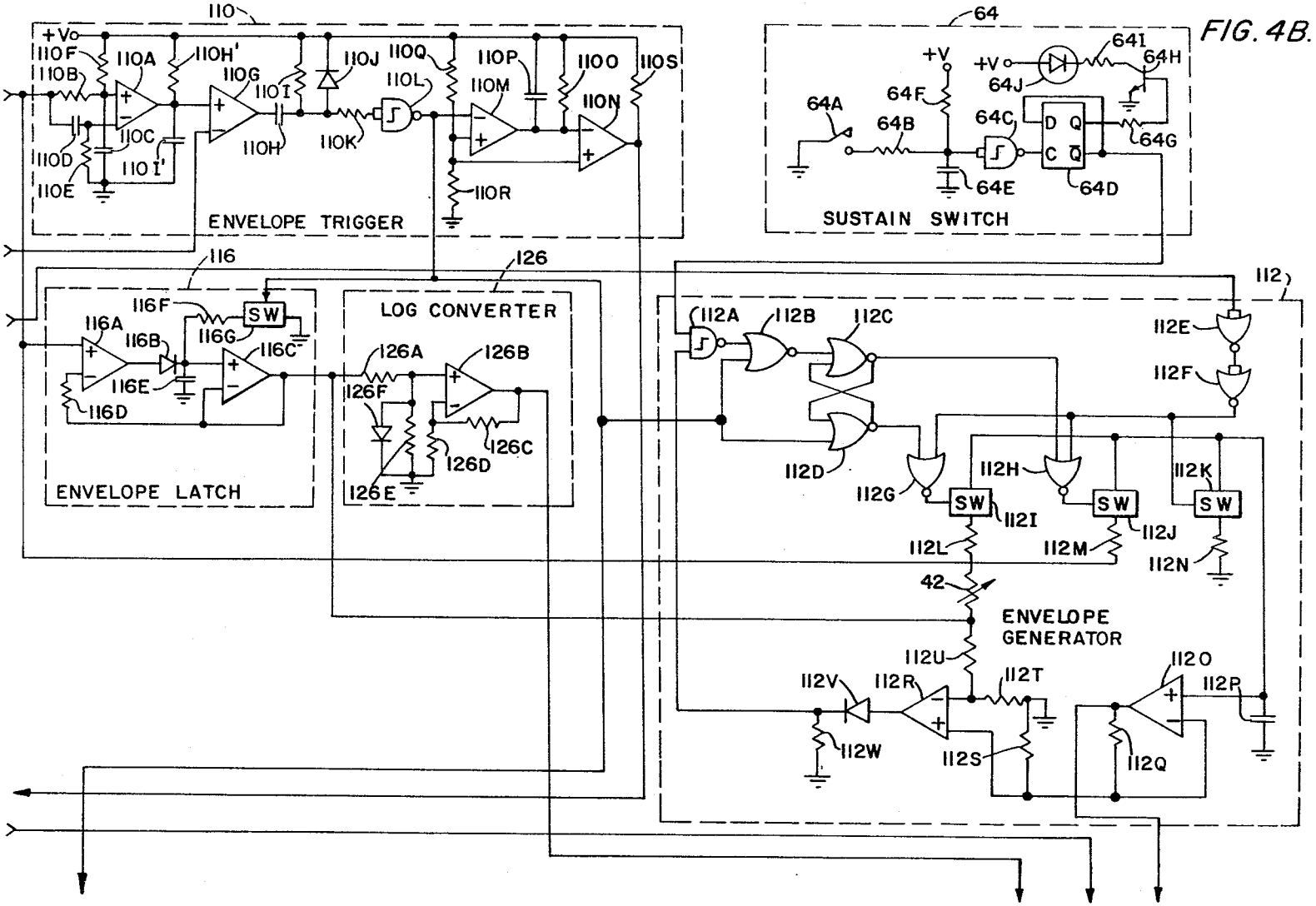

Referring now to FIG. 4B, the output from amplifier 108C in envelope follower 108 is applied to the non-inverting input of comparator 110A in envelope trigger 110 through resistor 110B. The junction between resistor 110B and the non-inverting input of comparator 110A is coupled through capacitor 110C to ground. Resistor 110B and capacitor 110C thus form a low pass filter. The envelope follower signal from envelope follower 108 is also applied through capacitor 110D to the inverting input of comparator 110A. The junction between capacitor 110D and the inverting input of comparator 110A is applied through resistor 110E to ground. Capacitor 110D and resistor 110E thus form a high pass filter. Comparator 110A compares the signals at its two inputs and provides a signal related to this comparison. Since the envelope signal increases quickly to a maximum value and then decreases at a much slower rate, the high pass filter passes a signal during the rapid increase time and the low pass filter passes a signal during the slow decay time. Thus, at the onset of the envelope signal, when there is a rapid rise in magnitude, the signal value at the inverting input exceeds the signal value at the non-inverting input and a pulse appears at the output of comparator 110A. It should be noted that the non-inverting input of comparator 110A is coupled through resistor 110F to a source of positive voltage and resistor 110F functions as a biasing resistor to set the threshold offset for comparator 110A.

The output of comparator 110A is applied through a monostable multivibrator consisting of comparator 110G, resistor 110H and capacitor 110I'. The output from comparator 110A is coupled to the non-inverting input of comparator 110G, through resistor 110H' to a source of positive voltage and through capacitor 110I' to ground. The inverting input to comparator 110G is coupled to a reference voltage taken from the envelope gate circuit 114. The multivibrator consisting of comparator 110G, resistor 110H' and capacitor 110I' function as a hold-off monostable multivibrator to prevent any rapid fluctuations at the beginning of the envelope signal from initiating more than one envelope trigger signal.

The two millisecond pulse provided at the beginning of the envelope is provided by a monostable multivibrator consisting of capacitor 110H, resistor 110I, diode 110J, resistor 110K and inverter 110L, which may be a Schmitt trigger circuit. The time constant is determined by capacitor 110H and resistor 110I. The output of comparator 110G is coupled through serially connected capacitor 110H and resistor 110K to inverter 110L. The junction of capacitor 110H and resistor 110K is coupled to the source of positive voltage through resistor 110I and through the anode cathode path of diode 110J. Whenever an envelope change is sensed by comparator 110G, capacitor 110H is discharged and it requires two milliseconds to be recharged through resistor 110I to a value such that Schmitt trigger inverter 110L provides a low voltage signal. During the time capacitor 110H is being recharged, the output from inverter 110L is a high voltage, and this constitutes the two millisecond envelope trigger 108 signal.

The twenty millisecond envelope trigger signal is provided by the circuitry including comparators 110M and 110N, which function as a pulse stretcher which stretches the two millisecond pulse applied thereto to twenty milliseconds. The output from Schmitt trigger inverter 110L is applied to the inverting input of comparator 110M, the output of which is applied to the inverting input of comparator 110N. The output of comparator 110M is coupled through parallel resistor 110O and capacitor 110P to the source of positive voltage. Resistors 110Q and 110R are serially connected between positive voltage and ground to provide a point of reference voltage at the junction to the non-inverting inputs of comparators 110M and 110N. The output of comparator 110N is coupled through resistor 110S to the source of positive voltage.

Referring to envelope gate 114 in FIG. 4A, the output from rectifier 106 is applied to the inverting input of comparator 114A. The non-inverting input of comparator 114A is coupled to a source of reference voltage at the junction of the voltage divider consisting of resistors 114B and 114C serially coupled between the source of positive voltage and ground. The output from comparator 114A is coupled to the non-inverting input of comparator 114D, which has a reference voltage coupled to its inverting input from the junction of serially connected resistors 114E and 114F connected between positive voltage and a ground. The non-inverting input of comparator 114D is also connected through resistor 114G to a source of positive voltage and through capacitor 114H to ground. Resistor 114G and capacitor 114H together with comparator 114D form a monostable multivibrator which is continually triggered by the output of comparator 114A. The time constant of resistor 114G and capacitor 114H is selected so that for the lowest acceptable frequency for the input signal, the monostable multivibrator formed around comparator 114D will always be triggered by a new pulse provided to comparator 114A from rectifier 106. The output of comparator 114D is applied through resistor 114J to the non-inverting input of comparator 114A. In this manner the comparison taking place in comparator 114A after its initial triggering is between the voltage provided at the output of comparator 114D rather than the reference voltage. In operation, the components may be selected so that 0.6 millivolts is required to initially cause comparator 114A to provide a signal to trigger the multivibrator and thereafter the output signal from comparator 114D is fed back through resistor 114J to lower the reference voltage so that thereafter it only requires a 0.2 millivolt signal to cause output signals to appear from comparator 114A. In other words, envelope gate circuit 114 exhibits hysteresis such that it requires the 0.6 millivolt signal to initially trigger comparator 114A and thereafter only a 0.2 millivolt signal.

Referring to envelope latch 116 in FIG. 4B, the envelope signal from envelope follower 108 is applied to the non-inverting input of unipolar driver amplifier 116A. The output of amplifier 116A is applied through the anode cathode path of diode 116B to the non-inverting input of field effect high impedance source follower amplifier 116C. The output of amplifier 116C is coupled to its inverting input and through resistor 116D to the inverting input of amplifier 116A. The cathode of diode 116B is coupled through capacitor 116E to ground and through resistor 116F and analog switch 116G to ground. Analog switch 116G is conductive each time the two millisecond envelope trigger is provided from the output of inverter 110L in envelope trigger 110. The value of resistor 116F is selected so that capacitor 116E can completely discharge during the two milliseconds that switch 116G is conductive. In operation, the envelope signal is applied through amplifier 116A and diode 116B to charge up capacitor 116E. During the initial fast rise time of the envelope, capacitor 116E becomes quickly charged to the maximum value of the envelope signal. Thereafter as the envelope begins its decay portion, capacitor 116E maintains the maximum value charged since there is no discharge path coupled to it. The voltage stored by capacitor 116E is amplified by high impedance source follower amplifier 116C to provide the envelope latch signal. At the beginning of the next envelope signal, the two millisecond pulse from envelope trigger 110 closes switch 116G to allow capacitor 116E to discharge. Thereafter, it is charged to the maximum value of the next envelope signal in the same manner.

Sustain switch 64, which is operated by one of the footpads on footpad panel 14 shown in FIG. 1, is a latching switch, that is, once the foot depresses the footpad associated with sustain switch 64, a circuit changes states and remains in the changed state until such time as the sustain switch 64 footpad is again depressed. The circuitry associated with sustain switch 64 is shown in FIG. 4B and includes relay switch 64A corresponding to the footpad, which, when depressed, connects one end of resistor 64B to ground. The other end of resistor 64B is coupled through Schmitt trigger inverter 64C to the clock input of flip-flop 64D. The junction between resistor 64B and inverter 64C is coupled through capacitor 64E to ground and through resistor 64F to a source of positive voltage. The $\overline{Q}$ output of flip-flop 64D is connected to the data input thereof. The Q output of flip-flop 64D is connected through resistor 64G to the base of NPN transistor 64H. The emitter of transistor 64H is connected to ground and the collector of transistor 64H is connected through resistor 64I and the cathode anode path of light emitting diode 64J to a source of positive voltage. In operation, when the sustain footpad is depressed causing switch 64A to make contact, capacitor 64E discharges through resistor 64B, causing a low voltage to be inverted by inverter 64C to a high voltage. The rising edge of this voltage causes flip-flop 64D to be triggered to its opposite state. If flip-flop 64D is triggered to the set state, the $\overline{Q}$ output becomes positive and turns on transistor 64H and causes current to flow through light emitting diode 64J, thereby illuminating it to indicate that the sustain function is programmed. If flip-flop 64D is triggered to the reset state then the Q output is at a low voltage and transistor 64H is turned off and light emitting diode 64J will not have current flowing thereto and therefore will not be illuminated. In addition, the Q output of flip-flop 64D is a positive voltage.

Referring now to envelope generator 112, this is the primary circuit in synthesizer 10 for controlling the envelope of the synthesized signal. As should be recalled, the envelope rises to a value determined by the amplitude of the input signal and if the sustain switch is off decays to a value related to the value of the input signal. Envelope generator 112 includes two input NAND gate 112A having one input coupled to the $\overline{Q}$ output of flip-flop 64D in sustain switch circuit 64. The output of NAND gate 112A is coupled to one input of two input NOR gate 112B, the other input of which is the two millisecond envelope trigger signal provided from envelope trigger circuit 110. The output of NOR gate 112B is coupled as one input to two input NOR gate 112C, the output of which is coupled as an input to two input NOR gate 112D. The other input to NOR gate 112D is the two millisecond envelope trigger signal from envelope trigger circuit 110. The output of NOR gate 112D is coupled as the second input to NOR gate 112C. Coupled in this manner NOR gates 112C and 112D form a latch circuit. The enable signal from amplifier 114D in envelope gate circuit 114 is provided through a pair of inverters 112E and 112F as one input to NOR gates 112G and 112H. The second input to NOR gate 112G is provided from the output of NOR gate 112D and the second input of NOR gate 112H is provided from the output of NOR gate 112C. The output of NOR gate 112G is coupled to the enable input of analog switch 112I and the output of NOR gate 112H is coupled to the enable input of analog switch 112J. The output of inverter 112F is coupled to the enable input of analog switch 112K.

The envelope latch 116 output signal is provided through serially connected resistors 42 and 112L to one end of analog switch 112I. Resistor 42 is a potentiometer whose control lever is shown in FIG. 1 as the envelope onset control. The envelope signal provided from envelope follower 108 in FIG. 4A is provided through resistor 112M to one end of analog switch 112J. One end of analog switch 112K is coupled through resistor 112N to ground. The other ends of analog switches 112I, 112J and 112K are coupled together and provided to the non-inverting input of high impedance follower amplifier 112O. The non-inverting input of amplifier 112O is also coupled through capacitor 112P to ground. The output of amplifier 112O which is the envelope generator output signal, is coupled through resistor 112Q to the inverting input thereof. The junction between resistor 112Q and the inverting input of amplifier 112O is coupled to the non-invertng input of comparator 112R. The inverting input of amplifier 112O is coupled through resistor 112S to ground and the inverting input of comparator 112R is coupled through resistor 112T to ground, and through resistor 112U to the output of envelope latch circuit 116. Resistors 112U and 112Q are selected to be the same value and resistors 112S and 112T are selected to be the same value so that the loading on the signals applied to both inputs of comparator 112R is the same. The purpose of the comparator 112R is to compare the envelope generator 112 output signal against the envelope latch 116 signal and to provide a positive signal when the envelope generator 112 signal reaches the maximum value of the envelope latch 116 signal. This positive signal from comparator 112R is applied through diode 112V to the second input of NAND gate 112A. The cathode of diode 112V is coupled through resistor 112W to ground.

The operation of envelope generator 112 will now be explained, assuming first that sustain switch 64 is in the off position, that is, a positive voltage signal is applied from the $\overline{Q}$ output of flip-flop 64D to NAND gate 112A. Envelope generator 112 provides an envelope control signal for each note played on instrument 18, which rises to a maximum value determined by the maximum value of the envelope latch 116 signal at a rate determined by the setting on resistor 42. At the time each note is played, the output of comparator 112R is at a low voltage causing the output of NAND gate 112A to be at a high voltage. This, in turn, causes the output of NOR gate 112B to be at a low voltage. The two millisecond positive pulse from envelope trigger 110 applied to NOR gate 112D causes the output thereof to become low and thus the two inputs to NOR gate 112C are both low, and thus the output of NOR gate 112C is high. This high output is applied to the second input of NOR gate 112D to maintain its output low. The low output from NOR gate 112D is applied to NOR gate 112G, together with the low output from the enable signal, to cause the output thereof to be high and enable analog switch 112I to conduct the envelope latch 116 signal.

As should be recalled, at the beginning of the envelope, the envelope latch 116 signal rises with the envelope and this rising signal is applied through resistors 42 and 112L to charge capacitor 112P at a rate determined by the setting on resistor 42 and the rate and magnitude of the envelope latch 116 signal. The voltage stored by capacitor 112P is amplified by amplifier 112O and applied through resistor 112Q to the non-inverting input of comparator 112R. The envelope latch 118 signal is also provided through resistor 112U to the inverting input of comparator 112R. Once the envelope signal provided at the output of amplifier 112O reaches the value of the envelope latch 118 signal, a positive pulse is provided at the output of comparator 112R and applied to NAND gate 112A. This positive pulse signal, together with the positive signal from the $\overline{Q}$ output of latch 64D, causes the output of NAND gate 112A to become low. The low NAND gate 112A output signal, together with the now low envelope trigger 110 signal causes the output of NOR gate 112B to become high, thereby causing the output of NOR gate 112C to become low. This low value is cross-coupled to NOR gate 112D, which in response to the low envelope trigger 110 signal, provides a high output signal. The high output signal from NOR gate 112D is applied to gate 112G, which then provides a low output to turn off analog switch 112I.

The low signal from NOR gate 112C is provided through enabled NOR gate 112H to provide a high signal therefrom to enable analog switch 112J. Enabled switch 112J couples the output from envelope follower 108 through resistor 112M to capacitor 112P. Since the envelope follower 108 signal now is decreasing, it is at a value less than the value latched by envelope latch 116 and stored in capacitor 112P. Thus, capacitor 112P will discharge through resistor 112M and the envelope signal applied at the output of amplifier 112O will decrease in value. Ultimately, the voltage stored by capacitor 112P will become the actual envelope follower 108 voltage. If no further input notes are played on instrument 18, the enable signal becomes positive and both the NOR gates 112G and 112H are disabled and analog switch 112K is enabled by the output of inverter 112F. Resistor 112N is selected to be a low value, so capacitor 112P discharges quickly and the envelope signal at the output of amplifier 112O will become zero.

If the sustain switch 64 is in the on position, so that $\overline{Q}$ output from latch 64D is a low voltage, the output of NAND gate 112A will always be high regardless of the signal applied thereto from comparator 112R and the output of NOR gate 112B will always be low. In this situation, analog switch 112I will remain in the conductive condition and capacitor 112P will be maintained charged at a voltage equal to the envelope latch 116 voltage, at least until such time as the enable signal goes to a positive value and allows capacitor 112P to discharge through resistor 112N. Thus, when sustain switch 64 is in the on state, the envelope signal rises as the envelope latch signal rises at a time under the control of the setting on resistor 42 and then maintains the maximum value so attained.

Log converter circuit 126 converts the signal provided by envelope latch 116 to a signal having a voltage equal to the logarithm of the envelope latch 116 signal voltage. The output of amplifier 116C is provided through resistor 126A to the non-inverting input of logarithm amplifier 126B. The output of amplifier 126B is fed back through resistor 126C to the inverting input thereof. The inverting input of amplifier 126B is also coupled through resistor 126D to ground. The non-inverting input of amplifier 126B is coupled through parallel combination of resistor 126E and anode cathode path of diode 126F to ground. Coupled in this manner amplifier 126B and the associated components operate to convert the signal applied thereto into the logarithm of that signal.

Referring now to FIG. 4A, the output of non-linear amplifier 104 is applied to a second non-linear amplifier 128. Specifically the output of amplifier 104A is coupled through capacitor 128A and resistor 128B to the non-inverting input of amplifier 128C. The non-inverting input of amplifier 128C is coupled through parallel opposite poled matched diodes 128D and 128E to ground. The output of amplifier 128C is coupled through feedback resistor 128F to the inverting input thereof. The inverting input of amplifier 128C is also coupled through resistor 128G to ground. Connected in this manner amplifier 128C and the associated circuit components operate to amplify low magnitude signals with a greater gain than higher magnitude signals are amplified.

The output of non-linear amplifier 128 is connected to toggle circuit 130. Specifically, the output of amplifier 128C is connected to the inverting input of operational amplifier 130A and the non-inverting input of operational amplifier 130B. The output of operational amplifier 128C is also coupled through resistors 130C and 130D and capacitor 130E to ground. The junction between resistors 130C and 130D is coupled through resistor 130F to the non-inverting input of amplifier 130G. The output of amplifier 130G is coupled through the cathode anode path of diode 130H to the inverting input thereof and through resistor 130I to the inverting input thereof. The output of amplifier 130G is also coupled through the anode cathode path of diode 130J to the non-inverting input of amplifier 130A. The cathode of diode 130J is coupled through resistor 130K to the inverting input of amplifier 130G. The cathode of diode 130J is also coupled through capacitor 130L and resistor 130M to ground.

The junction between resistors 130C and 130D is also coupled through resistor 130N to the non-inverting input of operational amplifier 130O. The output of amplifier 130O is connected through the anode cathode path of diode 130P to the inverting input thereof. The output of amplifier 130O is also coupled through resistor 130Q to the inverting input thereof. The output of amplifier 130O is connected through the cathode anode path of diode 130R to the inverting input of amplifier 130B. The anode of diode 130R is coupled through resistor 130S to the inverting input of amplifier 130O. The anode of diode 130R is also coupled through serially connected capacitor 130T and resistor 130U to ground and through resistor 130V to ground.

Connected in the manner described, amplifier 130G and the associated components operate as a precision positive envelope follower for providing an envelope of the positive portion of the input signal provided thereto from non-linear amplifier 128 through resistor 130C, and amplifier 130O and the circuit components associated therewith operates as a precision negative envelope follower both providing the envelope of the negative portion of the input signal provided thereto from non-linear amplifier 128 through resistor 130C. A more detailed description of how these circuits operate is given in the aforementioned U.S. Pat. No. 3,911,776. The signal from non-linear amplifier 128 which consists of a series of alternating positive and negative voltage peak signals, having magnitudes following the envelope, is provided to the inverting input of amplifier 130A and the non-inverting input of amplifier 130B. Amplifiers 130A and 130B act as differential amplifiers and compare the positive and negative cycles of the amplified input signal against the detected envelope. In the case of amplifier 130A, the positive envelope is provided and each cycle having a positive wave shape causes a pulse to be provided at the output of amplifier 130A when each positive pulse reaches its maximum value. In the case of amplifier 130B the negative envelope is compared against each negative going pulse of the non-linear amplifier 128 signal and at each negative peak amplitude a pulse if provided from amplifier 130B. Thus, the pulse signals applied from amplifier 130A and from 130B are at the same frequency as the input signal but 180° out of phase with one another.

The output from amplifier 130A is coupled through resistor 132A and the anode cathode path of diode 132B to the set input of flip-flop 132C. The cathode of diode 132B is also coupled through the anode cathode path of diode 132D to a source of positive digital voltage, which may be five volts. The output from amplifier 130B is coupled through resistor 132E and the anode cathode path of diode 132F to the reset input of flip-flop 132C. The cathode of diode 132F is also coupled through the anode cathode path of diode 132G to the point of digital voltage. The Q output of flip-flop 132C is coupled to the clock input of flip-flop 132H. The $\overline{Q}$ output of flip-flop 132H is coupled to the D input thereof. The enable gate signal from the output of amplifier 114D is coupled through inverter 132I and resistor 132J to the reset input of flip-flop 132H. Resistor 132J is shunted by the anode cathode path of diode 132K. In addition, the junction between inverter 132I and resistor 132J is coupled to digital voltage through the anode cathode path of diode 132L.

Connected in this manner period counter driver circuit 132 provides from the Q output of flip-flop 132H, as a square wave, a pulse signal having a frequency equal to one-half the frequency of the input signal applied from music instrument 18. This occurs because during each cycle of the input signal, flip-flop 132C is set by the positive half wave of the cycle and reset by the negative half wave of the cycle, and thus provides a square wave pulse signal having a frequency equal to the input frequency. Flip-flop 132H acts as a divide by two counter, unless maintained reset when the enable signal from envelope gate 114 is not provided. The output from flip-flop 132H thus is a signal having one-half the frequency of the input signal, or, in other words, each positive half cycle of the output of flip-flop 132H occurs for the time of one complete cycle of the input signal.

Figure 4C:
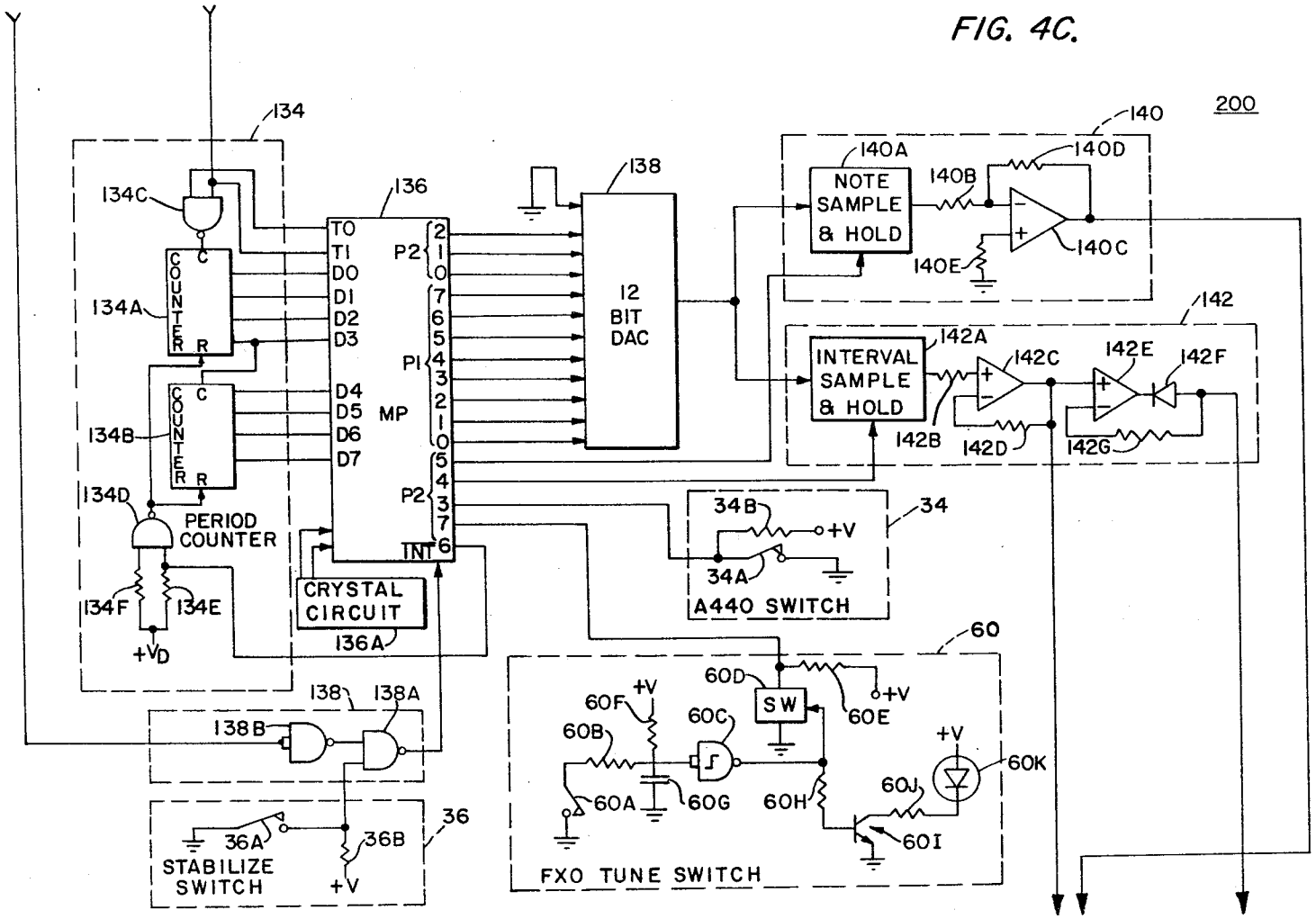

Referring now to FIG. 4C, digital to frequency analyzer 200 (DFA) will now be described. Digital to frequency analyzer 200 includes period counter 134, microprocessor 136, twelve bit digital to analog converter 138 and sample and hold circuits 140 and 142, together with stabilize switch 36, A440 switch 34, FXO tune switch 60 and gates 138. DFA 200 responds to the square wave signal applied from period counter 132 and specifically from the Q output of flip-flop 132H and provides voltages at the output of the sample and hold circuits 140 and 142 which control voltage control oscillators to oscillate at designated frequencies. Microprocessor 136 forms the heart of DFA 200 and may be any conventional microprocessor which includes memory, such as the Intel 8048 microprocessor. Crystal control circuit 136A is coupled to microprocessor 136 in a conventional manner and uses a crystal circuit designed to provide a 3.5 megahertz clocking signal to microprocessor 136, which clocking signal is provided at the T0 output of microprocessor 136. Microprocessor 136 also includes two input/output ports, P1 and P2, each having eight lines associated therewith, numbered respectively zero through 7. In addition, microprocesor 136 has a date input port, PO, having seven input lines for receiving data bits D0 through D7. The input/output ports P1 and P2 are bi-directional but as coupled in microprocessor 136 all lines 0–7 from port D1 are outputs, lines 0, 1,2,4,5, and 6 from port P2 are outputs, and lines 3 and 7 of port D2 are connected as input lines to receive signals from A440 switch 34 and FXO tune switch 60 respectively. Stabilize switch 36 is coupled through gates 138 to the interrupt input of microprocessor 136.

Period counter 134 includes two four stage counters 134A and 134B each having clock (C) and reset (R) inputs and four outputs representing the digital value of the count of the four stages thereof. The 3.57 megahertz clocking signal provided at the T0 output of microprocessor 136 is coupled to one input of NAND gate 134C. The other input of NAND gate 134C has the Q output from flip-flop 132H in period counter driver circuit 132 applied thereto. The Q output from flip-flop 132H in period counter driver circuit 132 is also applied as an input to the T1 input of microprocessor 136. The output of NAND gate 134C is coupled to the clock input of counter 134A and the most significant stage output of counter 134A is coupled to the clock input of counter 134B. The port 2 line 6 output from microprocessor 136 is coupled to one input of NAND gate 134D. That input of NAND gate 134D is also coupled through resistor 134E to a source of digital voltage. The second input to NAND gate 134D is coupled through resistor 134F to the source of positive digital voltage. The output from NAND gate 134D is coupled to the reset inputs of counters 134A and 134B. Whenever microprocessor 136 provides a logic "0" or low voltage signal from line 6 of port 2, the output of NAND gate 134D becomes logic "1" and resets counter 134A and 134B. If line 6 of port 2 of microprocessor 136 contains a logic "1" or high voltage signal, then the output of NAND gate 134D is a logic "0" and counters 134A and 134B are enabled to count the 3.5 Mhz clock signals applied thereto from the T0 output of microprocessor 136 through NAND gate 134C if the output from flip-flop 132H is logic "1". The eight output lines from counter 134A and 134B are applied to the D0 to D7 inputs of microprocessor 136 and manifest the count contained by counter 134A and 134B.

Stabilize switch 36, which is one of the controls on control panel 12, includes relay switch 36A, which is closed when footpad 36 is depressed and open otherwise, and resistor 36B. One end of resistor 36B is coupled to a source of positive voltage and when switch 36A is closed, the other end of resistor 36B is coupled to ground. The other end of resistor 36B is also coupled as one input to NAND gate 138A. The other input to NAND gate 138B is the output of inverter 138A which has applied thereto the twenty millisecond pulse signal from envelope trigger 110 in FIG. 4B. It should be recalled that this signal occurs at the beginning of each new note detected as the input signal. The output of NAND gate 138A is coupled to the interrupt input of microprocessor 136A.

FXO tune switch 60 is one of the footpads on footpad panel 14 and includes relay 60A which is normally in the open position but closed when the footpad is depressed by the foot. When relay 60A is closed it connects one end of resistor 60B to ground; the other end of resistor 60B is coupled through inverter 60C to the enable input of analog switch 60D. When switch 60D is enabled by the positive voltage signal applied thereto from inverter 60C, ground voltage is coupled to line 7 of port 2 of microprocessor 136. When switch 60D is not enabled, positive voltage is applied to line 7 of port 2 of microprocessor 136 through resistor 60E which is coupled from the output of switch 60D to a source of positive voltage. The input to inverter 60C is coupled through resistor 60F to a source of positive voltage and through capacitor 60G to ground. Capacitor 60G is charged to a positive voltage through resistor 60F to maintain the output of inverter 60C at a low value, thereby disabling switch 60D whenever relay 60A is in the open position. When relay 60A is closed, capacitor 60G discharges through resistor 60B and the input to inverter 60C becomes low, thereby causing the output to become high. The output of inverter 60C is also coupled through resistor 60H to the base of transistor 60I. The emitter of transistor 60I is coupled to ground and the collector of transistor 60I is coupled through resistor 60J and the cathode anode path of light emitting diode 60K to a source of positive voltage. When the output of inverter 60C becomes positive, transistor 60I is rendered conductive and thereby causes current to flow through light emitting diode 60K, which in turn causes it to become illuminated, indicating to the operator that the FXO tune switch has been depressed.

A440 switch 34 includes reed relay 34A and resistor 34B. When it's desired for synthesizer 10 to emit a sound equivalent to note A440, reed relay is opened; otherwise it is maintained in a normally closed position. When closed, reed relay 34A connects line 3 of port 2 of microprocessor 136 to ground. When reed relay 34A is in the open position, line 3 of port 2 of microprocessor 136 is coupled through resistor 34B to a source of positive voltage.

Lines 0 through 7 of port 1 and lines 1 through 2 of port 2 of microprocessor 136 are coupled to eleven of the twelve inputs of twelve bit digital to analog converter 138. The twelve and most significant bit of digital to analog converter 138 is coupled to ground. Digital to analog converter 138 converts the digital signal applied thereto from microprocessor 136 to a negative analog voltage which is applied at its output.

The output of digital to analog converter 138 is coupled to sample and hold circuits 140 and 142. Sample and hold circuit 140 includes note sample and hold circuit 140A to which the digital to analog converter 138 signal is applied as the main input. Line 5 of port 2 of microprocessor 136 is coupled to the enable input of note sample and hold circuit 140A and when enabled logic note sample and hold circuit 140A causes the voltage applied to the main input thereof to be provided at the output thereof until it is again enabled by a signal from microprocessor 136. The output of the note sample and hold circuit 140A is coupled through resistor 140B to the inverting input of high impedance follower amplifier 140C. The output of amplifier 140C is coupled through resistor 140D to the inverting input thereof. The non-inverting input of amplifier 140C is coupled through resistor 140E to ground. The value of resistors 140D and 140B are selected to be equal so that amplifier 140C has a gain of minus one. Thus the output of amplifier 140C is a positive voltage having a magnitude equal to the output of note sample and hold circuit 140A.

Sample and hold circuit 142 includes interval sample and hold circuit 142A which has the output of digital to analog converter 138 coupled to its main input. The enable input to the interval sample and hold circuit 142A is controlled by line 4 of port 2 of microprocessor 136 and, when enabled, sample and hold circuit 142A provides a voltage at its output equal to the voltage applied to its input from digital to analog converter 138. The output of interval sample and hold circuit 142A is applied through resistor 142B to the non-inverting input of high impedance follower amplifier 142C. The output of amplifier 142C is coupled through resistor 142D to the inverting input thereof. Resistors 142B and 142D are selected to be equal so that the gain of amplifier 142C is one. The output from amplifier 142C is coupled to a precision negative rectifier which includes amplifier 142E having its non-inverting input coupled to the output of amplifier 142C, and its output coupled through cathode anode path of diode 142F. The anode of diode 142F is coupled to resistor 142G to the inverting input of amplifier 142D. Connected in this manner the negative voltage applied at the output of interval ssmple and hold circuit 142A appears at the output of amplifier 142C and as long as the output voltage of interval sample and hold circuit 142A is negative, the output appears at the output of amplifier 142E and the anode of diode 142F.

Figure 5:
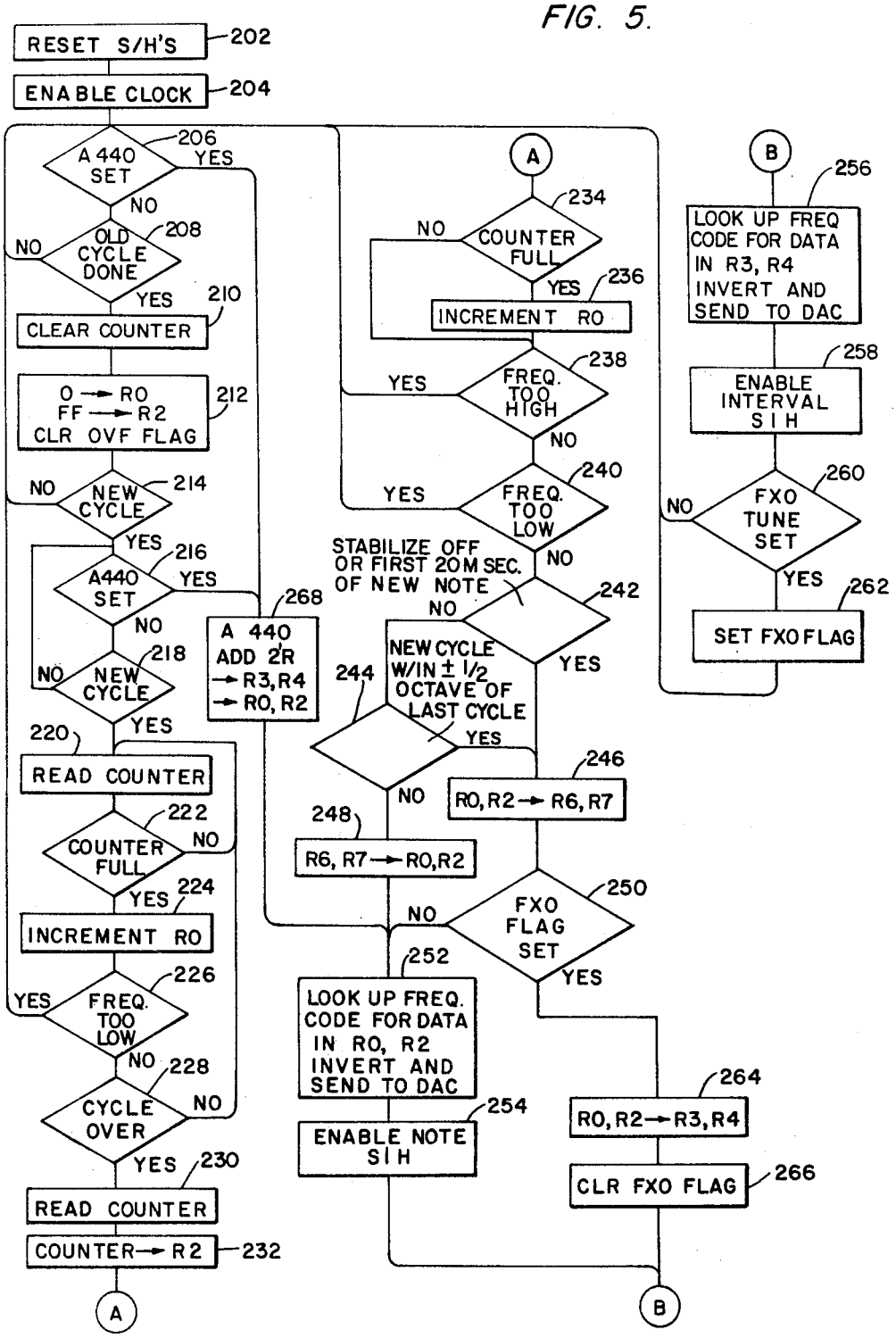
FIG. 5 is a flow diagram of the operation of the digital to frequency analyzer.

The operation of digital to frequency analyzer 200 will now be described with reference being made to FIG. 5, which shows a block diagram of the program of microprocessor 136 and which program is shown attached hereto in Appendix I. Referring now to FIG. 5, the set of instructions in microprocessor 136 which occurs upon power up causes both sample and hold circuits 140A and 142A to be reset. This occurs by providing a zero voltage out through lines 4 and 5 of port 2 of microprocessor 136. This is indicated by block 202 in FIG. 5. Next, according to block 204, the clock is enabled, which causes pulses at a frequency of 3.5 megahertz to be applied from output T0. Then, according to block 206, a determination is made whether the A440 switch 34A is open or closed. This occurs by reading port 2 and determining the polarity of the input 3 signal. If it is a logic "1" a jump occurs. Assuming for the present that the A440 switch is not set, then according to block 208 a determination is made whether the previous cycle is finished by determining whether the T1 input signal is low. If the T1 input is still high, the return to block 206 occurs. When the T1 input is low, then according to block 210, the counter is cleared by providing a logic "0" pulse over line 6 of port 2. Then, as indicated by block 212, register R0 is set to a count of zero; register R2 is set to a count of FF hexadecimal, or to a count of all "1"'s, and the overflow flag is cleared.

Next, according to block 214, a determination is made whether a new cycle has begun by seeing if the signal at input T1 has gone high; if it is still low, a return to block 206 occurs. Assuming that a new cycle has begun, block 216 indicates that a determination is made whether the A440 switch 34 has been set again. Again assuming that is not the case, block 218 indicates a determination is made whether a new cycle is beginning and if not, blocks 216 and 218 are repeated. This determination continues until such time as a new cycle is found to occur by waiting for the signal at the T1 input to go high. Once this occurs, block 220 and block 222 indicate that counters 134A and 134B are read until such time as they are full. At this time, block 224 indicates internal register R0 is incremented and according to block 226, a determination is made whether the frequency is too low. If it is, a return to block 206 occurs. The frequency determination at block 226 is made by checking the value of register R0, and if it reaches a certain value above which it should not go, then the determination is that the frequency is too low.

Next, at block 228, a determination is made whether the cycle has been completed by checking the signal at T1 to find if it has gone to a low value. Until the T1 input to signal becomes low, block 228 indicates that a return to block 220 occurs and the same procedure at blocks 220, 222, 224, 226, and 228 is repeated. Once it is determined that the cycle is over, block 230 indicates that the counter is read and block 232 indicates that the counter value is stored in register R2. Thus, registers R0 and R2 contain the count of the number of 3.5 megahertz pulses counted during one complete cycle of the input signal. Then, continuing with block 234, a determination is made whether at the time the counter was read it was full; if so, according to block 236 register R0 is incremented. Otherwise a continuation occurs with block 238 where the frequency is checked to determine if it is too high. If so, a return to block 206 occurs. Then at block 240 a determination is again made to check if the frequency is too low. If so, a return to block 206 occurs.

If the frequency is within the acceptable range, then block 242 indicates that a determination is made whether the stabilize switch is off or whether the twenty millisecond trigger signal from envelope trigger 110 is occurring. This is accomplished by checking the interrupt input to determine if it is low. If the interrupt input is high, then block 244 indicates that the present cycle is checked against the most recent occurring acceptable cycle to determine if it is within plus or minus one-half octave thereof. This would normally be the case for a given note and would only not be within plus or minus one-half octave if a noise interference signal were detected by synthesizer 10. Assuming that the present signal being checked is within plus or minus one-half octave of the previous cycle, then block 246 indicates that the values stored in registers R0 and R2 are stored in registers R6 and R7. If at block 244 it is found that the cycle being checked was not within one-half octave of the previous cycle, then, as indicated at block 248 the values stored for the previous accepted cycle stored in registers R6 and R7 are transferred to registers R0 and R2 to become the note to be played.

Assuming that the cycle being tested was within plus or minus one-half octave of the preceding cycle, and the values in register R0 and R2 were stored in registers R6 and R7, then block 250 indicates that a determination is made whether the FXO flag has been set. Assuming that if it has not, then block 252 indicates that the frequency code is looked up in a table for the time related data stored in registers R0 and R2. The table is a 1/X table since frequency is the inverse of time. Once the proper frequency data is obtained, it is sent out to digital to analog converter 138. Then, according to block 254, the note sample and hold circuit 140A is enabled by providing a logic "1" signal over line 5 of port 2. Then, block 256 indicates that a similar procedure is undertaken for the data stored in registers R3 and R4 and appropriate data is sent out to digital to analog converter 138 and according to block 258 interval sample and hold 142A is enabled. As will be explained hereafter, the data stored in registers R3 and R4 is equivalent to the stored time for a single cycle of the note immediately following the most recent closure of the FXO tune switch 60A.

Next, according to block 260, a determination is made whether FXO tune switch 60 is closed. This may be done by checking the value of the signal applied to line 7 of port 2 and if it is a logic "0" then according to block 262 the FXO flag is set. After the FXO flag is set at block 262, or if it was determined that FXO tune switch 60 was not set at block 260, a return to block 206 occurs and a repetition of what has just been described occurs, with the exception that at block 250 it will be determined that the FXO flag is set. In this case, block 264 indicates that the values stored in the R0 and R2 registers are stored in registers R3 and R4 so that thereafter the values looked up, and sent to digital to analog converter 138 at block 256 will be the new values stored in registers R3 and R4. Block 266 indicates that thereafter the FXO flag is cleared.

If at block 206 or at block 216 it was determined that the A440 switch 34 had been set, then block 268 indicates that data relating to the time between cycles for the note A440 is stored in registers R3 and R4 and in registers R0 and R2.

Thus it can be seen that whenever an input signal is played, a voltage will be provided from sample and hold circuit 140 relating to the frequency of that note, and a voltage will be applied from sample and hold circuit 142 relating to the frequency of the note played at the last depression of the FXO tune switch 60.

Figure 4D:
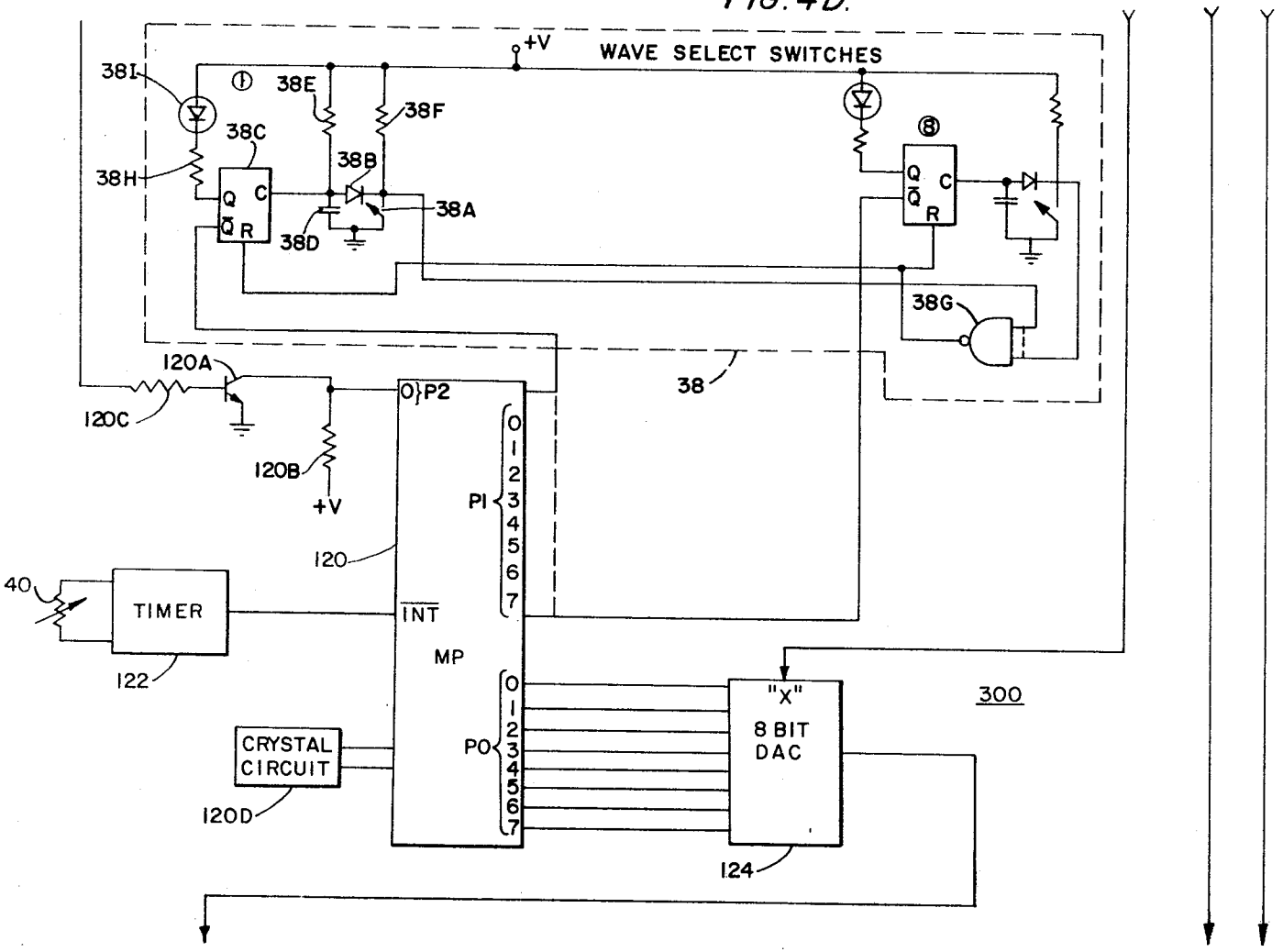
Figure 4E:
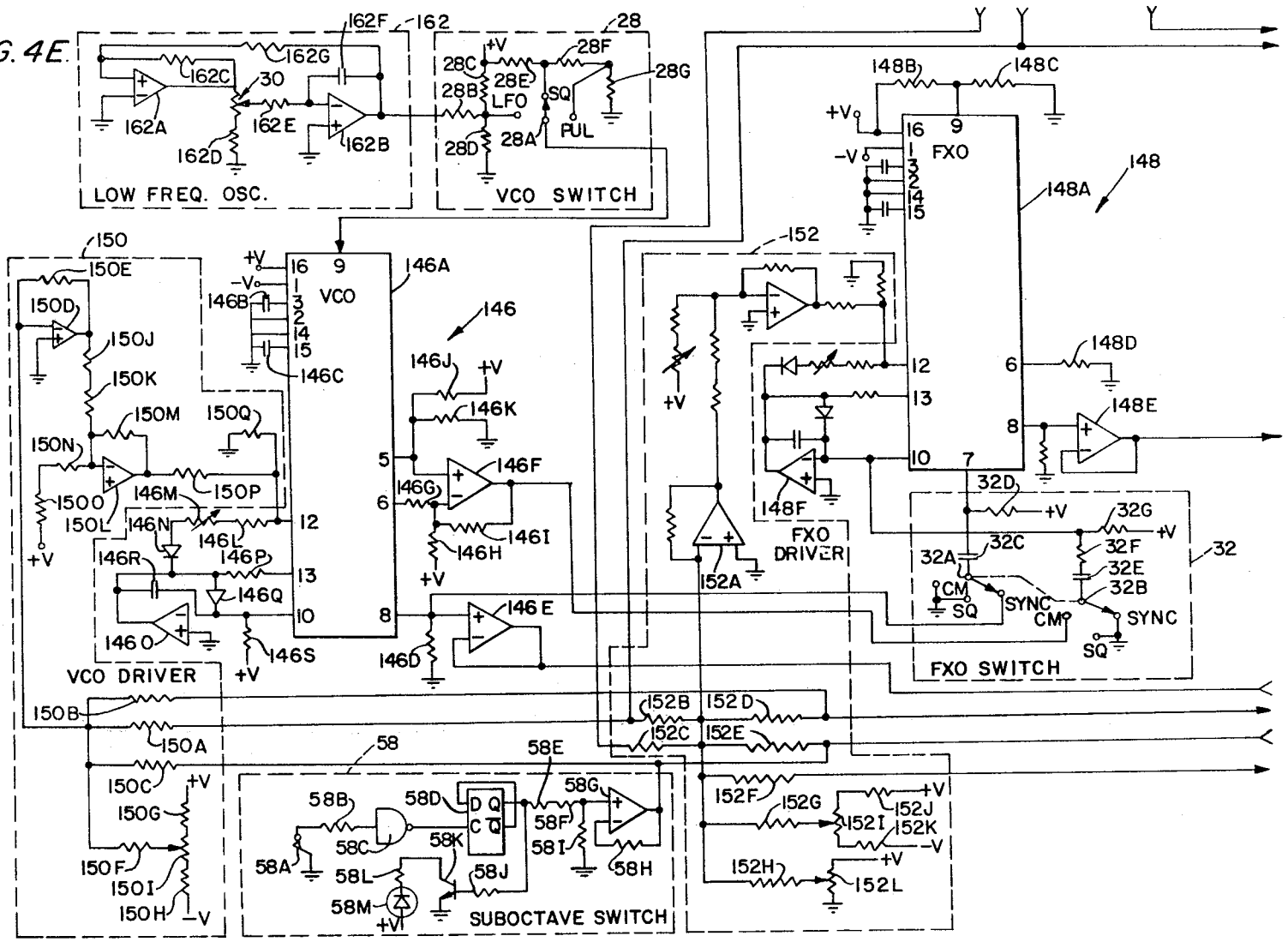

Referring now to FIG. 4E, VCO 146 and FXO 148 voltage controlled oscillator circuits are shown. These circuits consist primarily of voltage controlled oscillator 146A and voltage controlled oscillator 148A, each of which may be SSM 2030 voltage controlled oscillators which may be purchased from Solid State Music, Inc. of Santa Clara, California. Voltage controlled oscillators 146A and 148A are 16 pin integrated circuits. In voltage controlled oscillator 146A pin 16 is coupled to a source of positive voltage and pin 1 is coupled to a source of negative voltage. Pins 2 and 14 are coupled to ground and pins 3 and 15 are coupled through capacitors 146B and 146C respectively to ground. VCO driver 150 provides the control voltage to pin 12 in a manner which will be explained hereafter. The square wave output signal consisting of a series of pulses at a frequency determined by the voltages applied to pin 12 is provided at pin 8. Pin 8 is coupled through resistor 146D to ground and to the non-inverting input of operational amplifier 146E. The output of amplifier 146E is coupled to the inverting input thereof. Pin 5 of voltage controlled oscillator 146A is coupled to the non-inverting input of operational amplifier of 146F and pin 6 is coupled through resistor 146G to the inverting input of amplifier 146F. The inverting input of amplifier 146F is also coupled through resistor 146H to positive voltage and the output of amplifier 146F is coupled through resistor 146I to the inverting input thereof. Pin 5 is also coupled to the junction between resistors 146J and 146K. The other end of resistor 146J is coupled to positive voltage and the other end of resistor 146K is coupled to ground. The output of amplifier 146F is a triangle wave having a frequency equal to the frequency of the pulses provided from pin 8 of voltage controlled oscillator 146.

As previously mentioned, the control voltage from VCO driver 150 is applied to pin 12 of voltage control oscillator 146A. Oscillator 146A is designed such that it provides a frequency of 400 hz when zero volts is applied to pin 12 and a frequency which doubles for each plus one volt applied and which is halved for each negative one volt applied. Pin 12 is also coupled through resistor 146L, potentiometer 146M, and the anode cathode path of diode 146N to the output of FET amplifier 146O. The output of amplifier 146O is also connected through resistor 146P to pin 13 of voltage control oscillator 146A and through the anode cathode path of diode 146Q to the inverting input of amplifier 146O. In addition, the output of amplifier 146O is connected through capacitor 146R to the inverting input thereof. The inverting input of amplifier 146O is also coupled to pin 10 of voltage control oscillator 146A and through resistor 146S to a source of positive voltage. The non-inverting input of amplifier 146O is coupled to ground. Coupled in this manner amplifier 146O operates as a high impedance, low bias current driver for causing voltage controlled oscillator 146A to respond exponentially to the control voltage applied from driver 150.

Figure 4F:
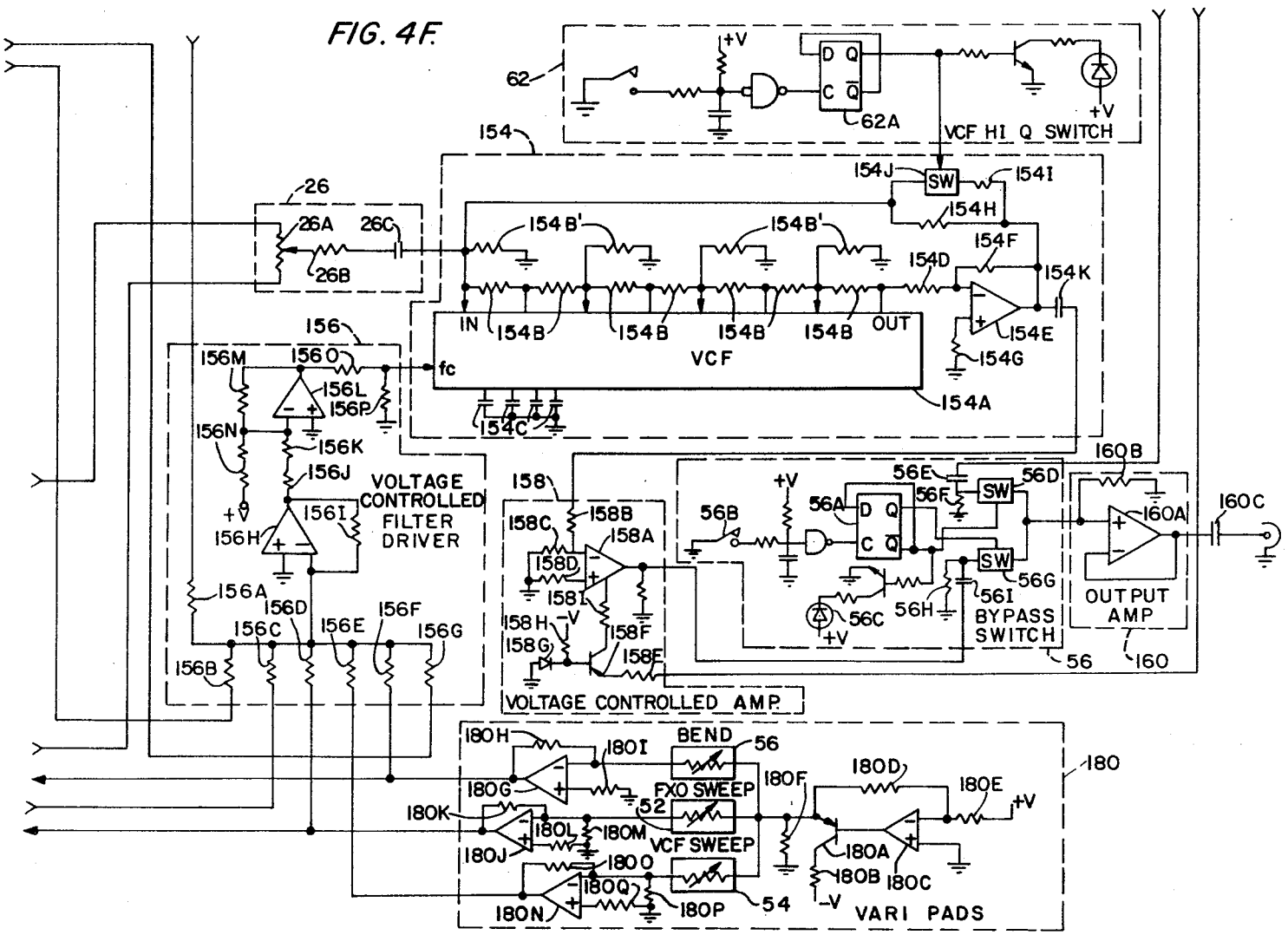

VCO driver 150 provides a DC voltage to input 12 of voltage control oscillator 146A to control frequency of the signals applied at pins 5 and 8 outputs of oscillator 146A. The primary voltage applied to VCO driver circuit 150 is the output of note sample and hold circuit 140, and specifically the output of amplifier 140C therein. This signal is applied through resistor 150A. In addition, the output of bend varipad 56, shown in FIG. 4F, is applied as a voltage through resistor 150B. The magnitude of the bend voltage applied through resistor 150B is dependent upon the amount of pressure placed on the bend footpad 50 and with maximum pressure will drop the frequency of the signal provided by voltage controlled oscillator 146A by one octave. The final control voltage applied to VCO driver circuit 150 is the output of suboctave switch 58, and is a voltage sufficient to drop the frequency of the signal provided by voltage control oscillator 146A by one octave. The suboctave voltage is applied through resistor 150C. The ends remote from the switches or sample and hold circuit 140 of resistors 150A, 150B and 150C are coupled together and applied to the inverting input of operational amplifier 150D. The non-inverting input of amplifier 150D is coupled to ground and the output of 150D is coupled through resistor 150E to the inverting input thereof.

In addition to the voltages applied through resistors 150A, 150B and 150C, a calibrated offset voltage is applied to cause an actual voltage to be applied to voltage control oscillator 146A which causes a signal having a frequency of the output to be that of A440 when A440 switch 34 is set. The calibrated offset voltage is applied due to the inclusion of resistors 150F, 150G and 150H and potentiometer 150I. Resistors 150G, potentiometer 150I and resistor 150H are serially coupled between the positive and negative voltages and the center tap of potentiometer 150I is coupled through resistor 150F to the junction of resistors 150A, 150B and 150C. The center tap of potentiometer 150I is adjusted so that the proper voltage is applied to voltage control oscillator 146A when A440 switch 34 is set.

The output of amplifier 150D is coupled through resistors 150J and 150K to the inverting input of operational amplifier 150L. The output of amplifier 150L is coupled through resistor 150M to the inverting input thereof. The non-inverting input of amplifier 150L is coupled to ground. The inverting input of amplifier 150L is also coupled through resistors 150N and 150O to a source of positive voltage. The output of amplifier 150L is coupled through resistor 150P to pin 12 of voltage control oscillator 146A. Pin 12 is also coupled through resistor 150Q to ground.

Connected in this manner, the voltages applied through resistors 150A, 150B and 150C control voltage control oscillator 146 to provide a pulse signal at output 8 and a triangle signal at output 5 which have a frequency related to the frequency of the input signal as modified by the control voltages due to the depression of the bend varipad 56 or the engagement of the suboctave switch 58. The components are selected so that the frequency of voltage controlled oscillator 46A changes by one octave for each one volt change in the signal applied to pin 12.

Pin 9 of voltage control oscillator 146A is used to control the duty cycle of the pulses applied by voltage controlled oscillator 146. VCO switch 28 includes three position switch 28A which can be placed in a position such that a control voltage is applied to pin 9 to cause a 50% duty cycle, or square wave signal, or in a position to cause a 30% duty cycle, or pulse wave signal, or in a position to cause a low frequency triangle wave, controllable by LFO potentiometer 30 on control panel 12 to be applied to pin 9 to pulse width modulate the output pulses of voltage controlled oscillator 146A.

Low frequency oscillator 162 includes potentiometer 30 and operational amplifiers 162A and 162B. The inverting input of amplifier 162A is coupled to ground and the output of amplifier 162A is coupled through resistor 162C to the non-inverting input thereof. The output of amplifier 162A is also coupled through serially connected potentiometer 30 and resistor 162D to ground. The center tap of potentiometer 30 is coupled through resistor 162E to inverting input of amplifier 162B. The non-inverting input of amplifier 162B is coupled to ground and the output of amplifier 162B is coupled through capacitor 162F to the inverting input thereof. The output of amplifier 162B is coupled through resistor 162G to the non-inverting input of amplifier 162A. Connected in this manner the output of amplifier 162B is a triangle wave having a frequency between one and twenty hertz dependent upon the setting of the center tap of potentiometer 30. Specifically, the amplifier 162A circuit is a hysteresis comparator and the amplifier 162B circuit is an integrator.

The low frequency triangle wave from low frequency oscillator 162 is applied through resistor 28B to the low frequency oscillator (LFO) input of switch 28A. The low frequency oscillator input to switch 28A is also coupled between resistors 28C and 28D with the other end of resistor 28C being coupled to a source of positive voltage and the other end of resistor 28D being coupled to ground. Resistors 28E, 28F, and 28G are serially coupled between positive voltage and ground. The junction between resistors 28E and 28F is coupled to the square wave input of switch 28A and the junction between resistors 28F and 28G is coupled to the pulse wave input of switch 28A. Connected in this manner resistors 28E, 28F and 28G are a voltage divider and the movement between the switching arm of switch 28A between the square wave setting and the pulse wave setting causes a different voltage to be applied to pin 9 of oscillator 146A. Moving the switching arm to the low frequency oscillator setting causes the triangle wave to be applied to pin 9 of oscillator 146A.

FXO 148 includes voltage control oscillator 148A which is connected similarly to voltage control oscillator 146A with the exception that pin 9 has a voltage applied thereto from the junction of resistors 148B and 148C which are serially coupled between positive voltage and ground. In addition pin 6 is coupled through resistor 148B to ground, and pin 5 is not coupled to anything. Pins 2, 3, 14, 15, 12, 13, 10, and 8 of voltage control oscillator 148A are coupled in the same manner as described with respect to voltage control oscillator 146A. The output from oscillator 148A is taken from the output of amplifier 148E which acts as a low output impedance source follower.

The major addition to FXO 148 which does not appear with respect to VCO 146 is the addition of FXO switch 32. FXO switch 32 includes a pair of synchronized three position switches 32A and 32B having settings of synchronized (Sync), square (sq) and complex modulation (cm). The CM and Sq settings of switch 32A are connected to ground and the Sync and Sq settings of switch 32B are connected to ground. The Sync setting of switch 32A is coupled directly to pin 8 of VCO oscillator 146A and the CM setting of switch 32B is connected to the output of amplifier 146F, which provides a triangle wave at the frequency of voltage control oscillator 146A.

The switch arm of switch 32A is coupled through capacitor 32C to pin 7 of oscillator 148A. Pin 7 is also coupled through resistor 32D to positive voltage. Pin 7 of oscillator 148A is the phase synchronization input to oscillator 146A and forces it to lock onto the frequency or multiple thereof applied thereto. This creates harmonic effects in the FXO note which becomes an emphasized harmonic overtone.

When switch 32 is in the CM or complex modulation position, switching arm 32B is coupled to the triangle wave appearing at the output of amplifier 146F. When FXO switch 32 is in the CM position, the triangle wave is applied through capacitor 32E and resistor 32F to the inverting input of amplifier 148F to cause the pulses appearing at pin 8 of oscillator 148A to be frequency modulated. The inverting input of amplifier 148F is also coupled through resistor 32G to a source of positive voltage.

In the complex modulation mode, the modulation index or amount of modulation is equal to less than 100% of the carrier frequency which is the frequency of oscillator 148A. Complex modulation synthesis differs from normal FM in several ways. First, traditional FM uses sine wave modulation of a sine wave carrier. Complex modulation uses a triangle modulation of a square wave carrier because triangle modulation produces the effect of sine wave modulation with a slightly greater index. A square wave is used because the modulated sound is filtered by a low pass filter included in the voltage control filter 154 to produce the maximum density of overtones. The second difference is that the ratio of the carrier to modulator is the key element in the finding what overtones seem to be present. Because of this and the fact that the frequency of oscillator 148A is equal to the interval difference between the note played and A440, the user of synthesizer 10 can change sounds by playing music and capitalize on the fact that from a fixed frequency any other frequency is a mathematical ratio away from it. For instance, if oscillator 148A is programmed one-fifth higher than oscillator 146A, then the carrier to modulator ratio of five can produce a spectra with every fifth overtone missing. For example, a 5 to 1 ratio with a carrier frequency being 500 hertz and the modulator being 100 hertz produces a fundamental frequency at 100 hertz with overtones at 200, 300, 400, 500. In this situation, the carrier frequency is the fifth harmonic.

FXO driver circuit 152 is identical to VCO driver circuit 150 except for the inputs applied to amplifier 152A, which corresponds to amplifier 150D. The input voltages coupled to the inverting input of amplifier 152A are applied through resistors 152B, 152C, 152D, 152E, 152F, 152G, and 152H. One end of each of these resistors is coupled together and to the inverting input of amplifier 152A. The other end of resistor 152B is coupled to the note sample and hold circuit 140 and specifically the output of amplifier 140C. The other end of resistor 152C is coupled to the output of interval sample and hold circuit 142 and specifically the output of amplifier 142C. The other end of resistor 152D is coupled to the voltage provided from bend varipad 56 and the other end of resistor 152E is coupled to the voltage provided by suboctave switch 58. The other end of resistor 152F is coupled to the output of FXO sweep varipad 52, shown in FIG. 4F. Two offset voltages are also applied through resistors 152G and 152H to the inverting input of amplifier 152A. The offset voltage applied through resistor 152G is taken from the center tap potentiometer 152I which is serially coupled with resistors 152J and 152K between positive and negative voltages. The offset voltage applied through resistor 152H is taken from the center tap of potentiometer 152L which is coupled between positive voltage and ground. Potentiometers 152I and 152L are adjusted so that they provide a voltage equal to but opposite in polarity from the voltage provided from interval sample and hold circuit 142 when FXO 148 is programmed with the note A440.

In operation and assuming that no voltages are applied through resistors 152D, 152E or 152F to create special effects, the negative voltage applied from note sample and hold circuit 140 through resistor 152B and the positive voltage applied through resistor 152C from amplifier 142C, together with the offset voltages applied through resistors 152G and 152H causes the voltage applied to the inverting input of amplifier 152A to be the difference between voltages manifesting the note actually played and manifesting the amount the program note varies from the note A440. This difference would be similar to playing a chord on a piano in which the major key of the chord is played by oscillator 146A and the additional keys of the chord are played by oscillator 148A to produce a harmonizing effect.

Suboctave switch 58 is also shown in FIG. 4E and includes switch 58A which is closed when footpad 58 is depressed. The closure of switch 58A causes a ground signal to be applied through resistor 58B which signal is inverted by inverter 58C and applied as a positive going signal to the clock input of flip-flop 58D. The $\overline{Q}$ output of flip-flop 58D is coupled to the data input thereof and the Q output is coupled through resistors 58E and 58F to the non-inverting input of amplifier 58G. The output of amplifier 58G is the suboctave voltage which is that voltage necessary to cause frequency signal provided by oscillators 146A and 148A to drop by one octave. The output of amplifier 58G is coupled through resistor 58H to the inverting input thereof. The non-inverting input of amplifier 58G is also coupled through resistor 58I to ground. The Q ouput of flip-flop 58D is additionally coupled through resistor 58J to the base of transistor 58K. The emitter of transistor 58K is coupled to ground and the collector of transistor 58K is coupled through resistor 58L and the cathode anode path of light emitting diode 58M to positive voltage.

When switch 58A is depressed a positive going signal triggers flip-flop 58D and causes the Q output thereof to change states. If the Q output becomes logic "1", the voltage is amplified by amplifier 58G and provided as a control voltage to oscillators 146A and 146B to cause the frequency of the signal provided to drop by one octave. The positive voltage when the Q output of flip-flop 58D is also provided to render transistor 58K conductive and thereby allow current to flow through light emitting diode 58M to illuminate it thereby indicating that the suboctave switch is enabled. The next depression of switch 58A retriggers flip-flop 58D to the opposite state, thereby causing the output voltage from amplifier 58G to be zero, and turning off transistor 58K.

Referring now to FIG. 4D timbral image modulator 300 is shown, and includes the eight wave select switches 38, microprocessor 120, timer 122, and digital to analog converter 124, which is a conventional multiplying eight bit digital to analog converter, that is, the digital input applied to the inputs thereof is multiplied by the factor related to the voltage applied to a multiply input thereof and the resulting voltage is applied as an output thereof.

Wave select switches 38 includes eight identical switches two of which, one and eight, are shown. For brevity, only one of the switch circuits will be described in detail, it being understood that the remaining seven are all identical in construction. Each switch circuit includes a read relay 38A which is closed in response to the depression of the switch shown on front panel 12. One end of switch 38A is connected to ground. The other end of switch 38A is connected through the cathode anode path of diode 38B to the clock input of flip-flop 38C. The clock input of flip-flop 38C is also coupled through capacitor 38D to ground and through resistor 38E to a source of positive voltage. The cathode of diode 38D is coupled through resistor 38F to a source of positive voltage and to one input of NAND gate 38G, which has the corresponding point of each of the eight switches coupled as eight inputs thereto. Normally these lines are all logic "1", so that the output of NAND gate 38G is a logic "0". The output of NAND gate 38G is coupled to the reset input of each of the latches 38C in the eight switches.

When switch 38A is depressed, one of the inputs to NAND gate 38G becomes grounded, causing the output thereof to become logic "1" and resetting each of the flip-flops 38C. At the same time capacitor 38D discharges through diode 38B to ground and remains discharged until such time as switch 38A is opened.

The Q output of flip-flop 38C is coupled through resistor 38H and the cathode anode path of light emitting diode 38I to a source of positive voltage, and the $\overline{Q}$ output of flip-flop 38C is coupled to the line 0 of port 1 input of microprocessor 120. When flip-flop 38C is reset the Q output becomes zero allowing current to flow through light emitting diode 38I, thereby illuminating it, and the logic "1" signal is applied from the $\overline{Q}$ input of flip-flop 38C to microprocessor 120 indicates that switch 38A has been depressed. When switch 38A is again opened, capacitor 38D charges up quickly through resistor 38E, which is selected so that the time constant of resistor 38E capacitor 38D is low. This creates a rising edge signal at the clock input of flip-flop 38C which causes it to become set, thereby causing a logic "1" signal to be applied from the Q output of flip-flop 38C. This results in current ceasing to flow through light emitting diode 38I and is ceases being illuminated. Also, a logic "1" bit is applied from the $\overline{Q}$ output to microprocessor 120 to indicate that switch one is no longer depressed.

Microprocessor 120 which may be an Intel 8048 microprocessor includes three input/output ports, labeled P0, P1, and P2, each of which includes eight lines. Port P0 is an output port and provides a digital signal of eight bits to multiplying digital to analog converter 124. Port P1 is connected to the $\overline{Q}$ output of each of the flip-flops corresponding to flip-flop 38C in the eight switches in wave select switches 38. Port P2 only has the line 0 line thereof used and is coupled to the collector output of transistor 120A which has its emitter coupled to ground. The collector of transistor 120A is also coupled through resistor 120B to a source of positive voltage. The base of transistor 120A is coupled through resistor 120C to receive the two millisecond envelope trigger signal provided by envelope trigger 110. When the envelope trigger signal becomes positive, transistor 120A is rendered conductive thereby causing a ground, or logic "0", signal to be applied to line 0 of port P2. This indicates to microprocessor 120 that a new note has been detected.

The interrupt input of microprocessor 120 is coupled to the output of timer 122, which may be a conventional square wave pulse oscillator having a controllable frequency under the control of variable resistor 40, which corresponds to the TIM speed adjustment on control panel 12.

Also associated with microprocessor 120 is a crystal circuit 120D which causes a 3.5 megahertz clocking signal to be applied to microprocessor 120.

The purpose of the timbral image modulator 300 is to control the initial filtering of each new note. This occurs by a unique signal being provided from the output of multiplying eight bit digitals to analog converter 124 to control the cut-off frequency of voltage control oscillator 154. The human ear can detect the identity of a sound within the first tenth of a second of its existence. For instance, as soon as a note is played, the human ear can detect whether it is being played by a flute or a trumpet. In the prior art, music synthesizers used the envelope generator 112 signal to produce complex sound generation. This was done by changing the shape of the envelope signal itself. This led to the general comment that when a synthesizer imitated a traditional instrument, the sound quality sounded electronic and lacked a degree of realism. This, of course, resulted from the fact that the envelope of the signal was changed, thereby modifying the amplitude of the note. However, it is the frequency spectra that makes each note unique.

The shaping of a synthesized sound takes place in the voltage control filter and voltage control amplifier sections. Prior art studies have placed critical emphasis on the spectral envelope of a sound and the temporal envelope. The spectral envelope is a picture of the relative strength within a particular instrument's audible range and the temporal envelope is derived from the total perceived changes (the loudness and spectral changes) of real instruments when both are used in the synthesis of sounds using digital non-real time synthesis equipment. Thus, one can conclude that spectral changes are loudness changes since the lack of spectra creates a muted sound quality that is also lower in amplitude. In voltage controlled synthesizers a loudness change of, for instance, 3DB's requires a 0.3 volt change and this produces the least perceptible loudness change. However, a 0.3 volt change in the voltage control cut-off frequency is quite perceivable and in fact much smaller voltage changes are perceivable. Thus, it has been concluded that a more complex control voltage should be applied to the voltage control filter so that the complexity of the produced signal is better appreciated.

Thus, in synthesizer 10 the complex modifications of the signal are performed by applying voltages to the voltage control filter 154. Of the more important control voltages applied to control the cut-off frequency of voltage controlled filter 154 is the timbral image modulator 300 signals. The timing is such that the timbral image modulator 300 signals are applied during at least the initial or attack portion of the note, which as previously mentioned is most critical to the determination made by the human ear as to the sound being produced by the note. These signals may also be controlled by the setting on the potentiometer 40 to last for the duration of each note played on instrument 18.

The eight waves capable of being produced by timbral image modulator 300 are shown in FIG. 7 and the program used to obtain these waves is shown in the Appendix II attachment. FIG. 7A is a damped envelope such as would be found in a percussive type note. FIG. 7B is the opposite of FIG. 7A and causes a slow rise to a maximum value. FIGS. 7C, 7D and 7E are typical of wind instrument frequency envelopes and FIGS. 7F, 7G and 7H relate to flutter type of instrument, such as a flute, and have damped oscillations associated therewith.

Figure 6:
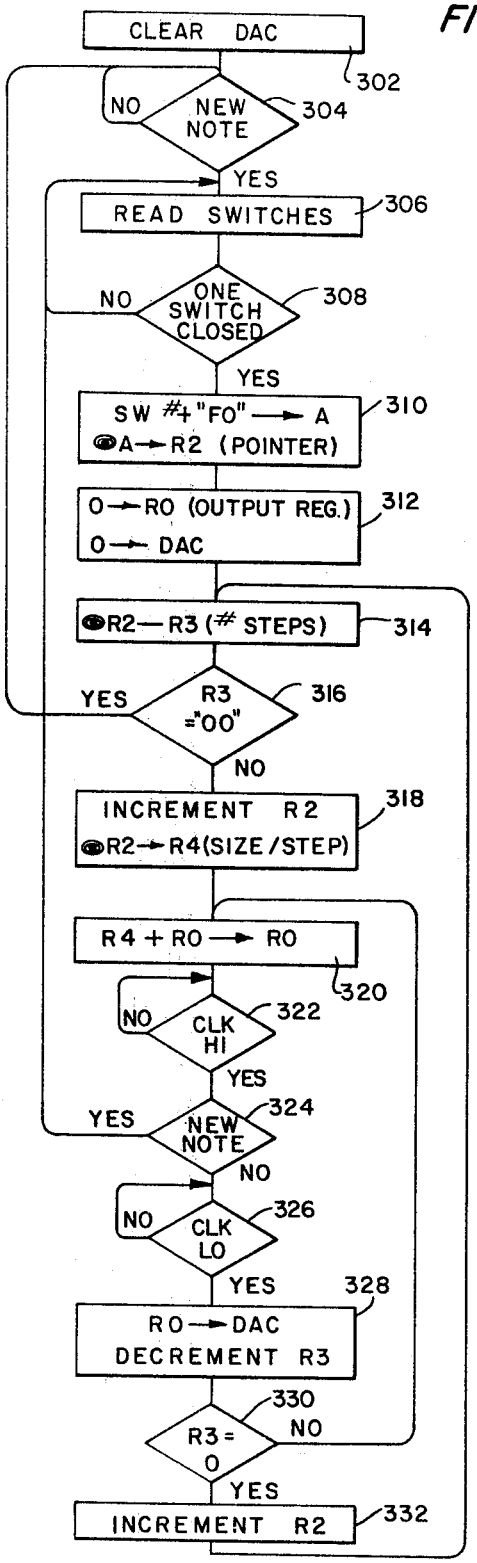
FIG. 6 is a flow diagram of the operation of the timbral image modulator.

Referring now to FIG. 6, a block diagram showing the operation of timbral image modulator 300 and specifically microprocessor 120 thereof is shown. The actual program contained within mircoprocessor 120 is shown in Appendix II attached hereto. According to block 302, upon power up digital to analog converter 124 is cleared by providing all zero bits to the inputs thereof. Then, according to block 304 a determination is made whether a new note is occurring by checking port 2 to determine if line zero has become logic "1". It should be recalled that the two millisecond envelope trigger signal is applied to line 0 of port 2 and becomes logic "1" at the beginning of each new note. Until a new note is detected, block 304 is continually performed.

Once a determination is made that a new note has occurred, then, according to block 306, switches 38 are read by reading the values provided to port 1. Block 308 indicates that next a determination is made whether only one switch has been closed. If no switches or more than one switch had been closed and a return to block 306 occurs and the switches are continually read until such time that it is determined that only one switch has been closed. Then, according to block 310 the hexadecimal number "F0" is added to the value of the line upon which the switch is read. For instance if switch 8 is closed then a logic "1" bit would be applied to line 7 and the number 7 would be added to the number "F0" to give the hexadecimal number "F7." The result of this addition is stored in the accumulator as an address in the memory pointer table. The pointer table contains the address of the first location of the code table portion of the memory which stores codes used to generate the desired waveshape. Also shown in FIG. 6 is the pointer and the code table for providing the waveshape shown in FIG. 7A. If switch 1 is depressed, resulting in line 0 of port 1 being logic "1", the pointer address would be "F0." As block 310 indicates, the pointer address is read and stored in register R2. In the case of switch 1 being depressed, the contents in location "F0" is "70", and this is the address of the code table containing the first code value to provide the waveform shown in FIG. 7A.

Next, according to block 312, output register R0 is cleared and the digital to analog converter 124 is cleared. Then, according to block 314, the contents of memory addressed by the pointer stored in register R2 is read and stored in register R3. In the example of switch 1 being depressed, the value stored in register R2 is 70 and thus the contents of memory address 70 is read and stored in register R3. The contents of address 70 is hexadecimal "01." The code table is organized such that the first value represents the number of steps and the second value represents the amount of each of those steps; the third value is the next number of steps, and the fourth value the amount of each of those steps, etc., until such time as the last value representing the number of steps is hexadecimal "00." In the case of the code table shown in FIG. 6, the first value of "01" indicates that one step of the second value, of "FF," which is equivalent to 256 occurs. Thereafter 9F (the third value) or 129 steps of adding FF (the fourth value) to the previous value occurs. By adding "FF" to the previous value, the net result is a minus 1. Hence the waveshape takes a sudden positive leap and then decreases over 130 steps to zero one step at a time. Since the fifth steps number is "00," block 316 utilizes this by determining whether the value stored in register R3 is equal to "00." If it is, the wave is over and a return to block 304 occurs. However, if the value for the step stored in register R3 is not "00," block 318 indicates that register R2 is incremented to point to the next location in the code table and the contents of the memory location addressed by the values stored in register R2 is read and stored in register R4. This will be the size of each step to be taken. Then, according to block 320, the values stored in register R4 is added to the values stored in register R0 or in other words, the amount of each step is stored in the output register containing the present position of the wave.

Next, according to block 322, a determination is made whether the signal from timer 122 is high. If not, this is continually checked until such time as timer 122 becomes high. Once timer 122 provides a high signal, a determination is made at block 324 whether a new note has occurred. If a new note has occurred, a return to block 306 is indicated. If a new note has not occurred, then block 326 indicates that a determination is made until the clock is low. It should be noted that signals are only produced during the time the clock is low, so that the new note is checked during the interim between low pulses of timer 122.

After timer 122 provides a low pulse to microprocessor 120, block 328 indicates that the values stored in register R0 is sent to digital to analog converter 124 and register R3 is decremented, thereby reducing by one the number of steps to be performed. Block 330 indicates that a test on R0 is performed to determine if it is equal to zero or, in other words, if all of the steps have been performed. If not, a return to block 320 occurs and the above is repeated. Once the value of register R3 becomes zero, then block 322 indicates that register R2 is incremented to point to the next memory location and a return to block 314 occurs, where the next memory location is read. Unless the next read memory location is a "00" the above is repeated.

Referring now to FIG. 4F, the output circuitry consists of voltage control filter driver 156, voltage control filter 154 and voltage control amplifier 158. In addition, FIG. 4F shows the VCF Hi-Q switch 62, the three varipad switches 50, 52 and 54, and the bypass switch 56 and output amplifier 160.

Voltage control filter 154 includes voltage control filter 154A, which may be a 2040 voltage control filter manufactured by Solid State Music, Inc. Filter 154A contains four identical filter stages, all of which are simultaneously controlled by the same exponential function generator. Filter 154A is connected as a low pass filter by connecting resistors 154B and capacitors 154C in a manner suggested by the manufacturer. The input signal consisting of a series of pulses from the voltage controlled oscillators 146A and 148A is applied to the input of filter 154A and a filtered output appears at the output of filter 154A. The output signal for filter 154A is applied through resistor 154D to the inverting input of amplifier 154E, the output of which is fed back through resistor 154F to the inverting input thereof. Resistors 154D and 154F are selected to be of equal value so that amplifier 154E acts as an inverter having unity gain. The non-inverting input of amplifier 154E is coupled through resistor 154G to ground. The output of amplifier 154E is coupled through resistor 154H to the input of filter 154A. Resistor 154I is coupled in series with analog switch 154J, the two of which are coupled in parallel with resistor 154H. Resistor 154I is substantially smaller in value than resistor 154H so that when analog switch 154J is enabled by a signal from VCF Hi-Q switch 62, the feedback path from the output to the input of filter 154A is much less resistive. In the prior art devices, the resistance of the feedback path of the voltage control filter is controlled by a potentiometer. However, very little difference in output sound occurs for the middle range of the potentiometer settings and the only perceivable differences are from a high resistance point to a low resistance point of the potentiometer. Thus, the potentiometer is replaced by analog switch 154J under the control of a footpad VCH Hi-Q switch 62 to obtain the nasal sound associated with large amounts of feedback in the voltage control filter. This allows the user of synthesizer 10 to change the sound by operating of a footpad rather than having to use his hands, which normally are occupied in playing the instrument, to control the filter feedback value during live performance.

VCF Hi-Q switch 62 is constructed similar to sustain switch 64 and a detailed description will not be repeated. The output from VCF Hi-Q switch 62 is taken from the Q output of flip-flop 62A included therein.

The input signal applied to filter 154A is taken from the center tap of potentiometer 26A, of which lever 26 is shown on control panel 12 in FIG. 1. The center tap of potentiometer 26A is coupled through resistor 26B and capacitor 26C to the input of filter 154. The two ends of potentiometer 26A are respectively coupled to the output of amplifier 148E associated with FXO 148 and amplifier 146E associated with VCO 146. The setting on potentiometer 26A controls the amount of effect that the VCO and FXO signals have upon the output signal.

The cut-off frequency (fc) of filter 154 is controlled by the voltage applied to the fc input thereof from voltage control filter driver 156. Voltage control filter driver 156 is responsive to seven different voltages applied to respective resistors 156A, 156B, 156C, 156D, 156E, 156F and 156G. The signal applied to resistor 156A is applied from the output of digital to analog converter 154 in timbral image modulator 300. The signal applied through resistor 156B is provided from the output of note sample and hold circuit 140; the signal provided through resistor 156C is provided from the output of suboctave switch 58 and the voltage provided through resistor 154D is provided from the FXO sweep varipad 52. The voltage provided through resistor 156E is provided from the VCF sweep varipad 54 and the voltage applied through resistor 156F is provided from the bend varipad 50. Finally, the FXO voltage is applied through resistor 156G from the output of amplifier 142E and diode 142F of interval sample and hold 142. Each of resistors 156A, 156B, and 156C, 156D, 156E, 156F and 156G are coupled together and to the inverting input of operational amplifier 156H. The non-inverting input of amplifier 156H is coupled to ground and the output of amplifier 156H is coupled through resistor 156I to the inverting input thereof. The output of amplifier 156I is coupled through serially coupled resistors 156J and 156K to the inverting input of operational amplifier 156L. The non-inverting input of amplifier 156L is coupled to ground and the output of amplifier 156L is coupled through resistor 156M to the inverting input thereof. The inverting input of amplifier 156 is also coupled through resistor 156N to positive voltage. The output of amplifier 156L is coupled through resistor 156O to the frequency controlled input of filter 156A. The junction between resistor 156O and the frequency control input of filter 154A is coupled through resistor 156P to ground.

Referring to varipads circuit 180, the three bend varipad 50, FXO sweep varipad 52 and VCF sweep varipad 54 are shown as variable resistors in which the resistance depends upon the amount of pressure applied to the varipad on footpad control 14. The input to each of the varipad resistors 50, 52 and 54 are coupled together and to the emitter of transistor 180A. The collector of transistor 180A is coupled through resistor 180B to a source of negative voltage. Amplifier 180C is coupled to provide a signal to the base of transistor 180A. The inverting input of amplifier 180C is coupled through resistor 180D to the emitter of transistor 180A and through resistor 180E to a source of positive voltage. The non-inverting input of amplifier 180C is coupled to ground. The emitter of transistor 180A is also coupled through resistor 180F to ground.

The output of bend varipad 50 is coupled to the inverting input of operational amplifier 180G, the output of which is coupled through resistor 180H to the inverting input thereof. The non-inverting input of amplifier 180G is coupled through resistor 180I to ground. The output of FXO sweep varipad resistor 52 is coupled to the inverting input of amplifier 180J, the output of which is coupled through resistor 180K to the inverting input thereof. The non-inverting input of amplifier 180J is coupled through resistor 180L to ground and the inverting input is coupled through resistor 180M to ground. The output of VCF sweep varipad resistor 54 is coupled through the inverting input of operational amplifier 180N, the output of which is coupled back through resistor 180O to the inverting input thereof, and through resistor 180P to ground. The non-inverting input of amplifier 180N is coupled through resistor 180Q to ground. Amplifiers 180G, 180J and 180N and the associated circuits components operate to amplify a voltage provided through the varipads resistors 50, 52 and 54 by amplifier 180C and transistor 180A, to the appropriate voltages to control voltage control filter driver 156, FXO driver 152 and VCO driver 150.

The output signal from voltage control filter 154 is a filtered version of the combination of the square wave inputs applied thereto from voltage controlled oscillators 146A and 148A. The cut-off frequency is determined by the control voltages inputs applied through voltage control filter 156 so that the output manifests a muscial sound frequency which is both automatically controllable by the timbral image modulator and operator controlled by various footpads, and the note played on instrument 18.

The output of voltage control filter 154 is applied through capacitor 154K to the inverting input of voltage control amplifier 158A through resistor 158B. The inverting input of voltage control amplifier 158A is coupled through resistor 158C to ground and the non-inverting input of amplifier 158A is coupled through resistor 158D to ground. The output of envelope generator 112, taken from the output of amplifier 112, is applied through resistor 158E to the emitter of transistor 158F. The base of transistor 158F is coupled through the cathode anode path of diode 158G to ground and through biasing resistor 158H to the source of negative voltage. The collector of transistor 158F is coupled through resistor 158I to control the gain of amplifier 158A.

The output of voltage control amplifier 158 will be a signal having a frequency equal to the frequency of the output of voltage control filter 154 and an amplitude related to the amplitude of the envelope generator 112 signal. The output of voltage control amplifier 158 is applied through bypass switch 56 to output amplifier 160 which consists of a conventional audio amplifier 160A in which the input signal is provided to the non-inverting input thereof from bypass switch 56. The output of amplifier 160A is coupled to the inverting input thereof and the non-inverting input is coupled through resistor 160B to ground. The output of amplifier 160A is coupled through resistor 160C as the synthesizer 10 output signal.

Bypass switch 56 consists of flip-flop 56A responsive to read relay switch 56B coupled with the same components and in the same manner as sustain switch 64, except that the $\overline{Q}$ output rather than the Q output of flip-flop 56A is coupled in circuit with light emitting diode 56C, whereby whenever flip-flop 56A is in the reset condition the bypass switch 56 is considered to be On and diode 56A is illuminated. The Q output of flip-flop 56A is coupled to enable analog switch 56D when flip-flop 56A is in a reset condition. The input to analog 56D is provided from the output of preamplifier 102 and it is the signal provided from music instrument 18. The input signal is provided through capacitor 56E to the input of switch 56D. The input of switch 56D is also coupled through resistor 56F to ground. The Q output from flip-flop 56A is coupled to the enable input of analog switch 56G which has its input coupled through resistor 56H to ground and through capacitor 56I to the output of amplifier 158A of voltage control amplifier 158. The output of switches 56D and 56G are coupled together and to the non-inverting input of output amplifier 160A. Thus, when flip-flop 156A is in the off position, switch 156G is enabled to pass the synthesized signal applied from the output of voltage controlled amplifier 158 and when flip-flop 56A is in the on condition the input signal applied to synthesizer 10 is applied through output amplifier 160.

The component values of the circuit shown in FIGS. 4A-4F are given in Appendix III.

APPENDIX I

```
        ANL P2, #OCF        MOV R1, A
        ENTO CLK            MOV A, R0
        MOV R7, #7          RLC A
START   IN A, P2            MOV R0, A
        JB3 WRTA            MOV A, #7
        JT1 START           XRL A, R2
        ANL P2, #OBF        JZ START
        ORL P2, #40         JC CKBIAS
        MOV R0, #0          INC R2
        MOV R2, #OFF        JMP ROTATE
        CLR F0      CKBIAS  MOV A, #OFF
        JT1 START           XRL A, R2
WAIT    IN A, P2            JZ START
        JB3 W2TA            JNI CKPK
        JNT1 WAIT   NEW     MOV A, R0
CKBIT7  INS A, BUS          MOV R6, A
        JB7 OVER            MOV A, R2
        JBO CLOVER          MOV R7, A
```

-continued

APPENDIX I

```
GATE      JT1 CKBIT7
          INS A, BUS
          MOV R1, A
          JB7 ROTATE
          JFO INCR
          JMP ROTATE
INCR      INC R0
ROTATE    CLR C
          MOV A, R1
          RLC A
          OUTL P1, A
          MOV A, R4
          CPL A
          ANL A, #7
          ORL A, #OC8
          OUTL P2, A
          NOP
          NOP
          ORL P2, #10
          CALL DELSH
          ANL P2 #OFF
          IN A, P2
          JB7 SETBF
          JMP START
SETBF     CLR F1
          CPL F1
          JMP START
OVER      CLR F0
          CPL F0
          JMP GATE
CLOVER    CLR F0
          INC R0
          MOV A #80
          XRL A, R0
          JZ START

          JMP GATE
WRTSH     MOV A, R0
          MOVP3, A @A
          CPL A
          OUTL P1, A
          MOV A, R2
          CPL A
          ANL A, #7
          INC R5
TEST 1    MOV A, R5
          JB7 LOWER
          JMP OCT
LOWER     MOV A, R1
          CPL A
          MOV R1, A

          MOV A, R5
          CPL A
          MOV R5, A
OCT       CLR C
          MOV A, R1
          ADDC A, #128
          MOV R1, A
          JNC TEST 2

          JNC R5

          NOP
          NOP
TEST 2    MOV A,R5
          JZ NEW
          MOV A, R6
          MOV R0, A
          MOV A, R7
          MOV R2, A
          JMP WRTSH
PEAK      JNI CKPK
          JMP NEW
          JFI CONT
          JMP WRTSH
CONT      MOV A, R0
          MOV R3, A
          MOV A, R2
          MOV R4, A
          CLR F1
WTBIAS    MOV A, R3
          MOVP3 A, @A
          CPL A

          ORL A, #OC8
          OUTL P2, A
          NOP
          NOP
          ORL P2, #20
          CALL DELSH
          ANL P2, #ODF
          JMP WTBIAS
DELSH     MOV R5 #SHDEL
LOOP      NOP
          DJNZ R5, LOOP
          RETR
WRTA      MOV A, #52
          MOV R0, A
          MOV R3, A
          MOV R2, #03
          MOV R4, #03
          JMP WRTSH
CKPK      MOV A, R0
          CPL A
          CLR C
          ADDC A, RG
          MOV RI, A
          MOV A, R7
          CPL A
          ADO6 A, R2
          MOV R5, A
          JNC TEST 1
          INC R1
          MOV A, R1
          JNC TEST 1
```

1/X TABLE

| ADDR | CONTENTS |
|---|---|
| 300 | 256 |
| 301 | 255 |
| 302 | 253 |
| 303 | 252 |
| 304 | 250 |
| ' | |
| ' | |
| 33B | 179 |
| 33C | 178 |
| 33D | 177 |
| 33E | 176 |
| 33F | 175 |
| 340 | 174 |
| 341 | 172 |
| ' | |
| ' | |
| ' | |
| 3FB | 5 |
| 3FA | 5 |
| 3FB | 4 |
| 3FC | 3 |
| 3FD | 2 |
| 3FE | 1 |
| 3FF | 0 |

APPENDIX II

```
CLR A                    CLR A
```

-continued

APPENDIX II

```
          OUTL P0
GATE      CLR C
          IN A, P2
          RRC A
          JC GATE
START     IN A, P1
          MOV R1, A
          CLR C
          MOV R6,
          #DATA
          MOV R5, #8
ROTATE    RLC A
          JNC 14
          INC R6
NEXT      DJNZ R5,
          ROTATE
          DJNZ R6,
          START
          CLR C
          MOV A, R1
          MOV R5, #0
COUNT     RLC A
          JC TABLE
          INC R5

          JMP COUNT
TABLE     MOV A, #60

          ADD A, R5
          MOVP A, @A
          MOV R2, A
          MOV R0, O
NGWROM    OUTL P0, A
          MOV A, R2
          MOVP A, @A
          MOV R3, A
          JZ GATE
          INC R2
          MOV A, R2
          MOVP A, @A
          MOV R4, A

NEXT 1    MOV A, R0
          ADD A, R4
          MOV R0, A
CLOCK     JNT1 CLOCK
NEWGATE   CLR C

          IN A, P2

          RRC A
          JNC START
CLOCK 1   JT1 CLOCK 1
          MOV A, R0
          OUTL PO, A
          DJNZ R3,
          NEXT
          1
          INC R2
          JMP NEWROM
```

ADDRESS TABLE

| ADD'R | DATA | | | | |
|---|---|---|---|---|---|
| 60 | 70 | 81 | OA | 9E | 00 |
| 61 | 75 | 82 | 12 | 9F | 08 |
| 62 | 7A | 83 | OA | AO | 05 |
| 63 | 81 | 84 | 07 | A1 | 05 |
| 64 | 90 | 85 | OA | A2 | FE |
| 65 | 9F | 86 | FF | A3 | 11 |
| 66 | BA | 87 | 14 | A4 | 05 |
| 67 | CF | 88 | 00 | A5 | OA |
| | | 89 | OA | A6 | F9 |
| | | 8A | 01 | A7 | OF |
| | | 8B | 19 | A8 | 06 |
| | | 8C | FF | A9 | 05 |
| | | 8D | 19 | AA | 00 |
| | | 8E | 00 | AB | 05 |
| | | 8F | 00 | AC | FF |
| | | 90 | 1H | AD | OA |
| | | 91 | 09 | AE | 07 |
| | | 92 | 14 | AF | OA |
| | | 93 | FD | BO | 05 |
| | | 94 | 08 | B1 | OA |
| | | 95 | 05 | B2 | FA |
| | | 96 | 06 | B3 | 1E |
| | | 97 | 03 | B4 | 01 |
| | | 98 | 05 | B5 | 14 |
| | | 99 | FE | B6 | FD |
| | | 9A | 14 | B7 | 14 |
| | | 9B | 04 | B8 | 01 |
| | | 9C | 3C | B9 | 00 |
| | | 9D | FF | BA | 11 |
| | | D9 | 14 | | |
| | | DA | F6 | | |
| | | DB | 14 | | |
| | | DC | 02 | | |
| | | DD | 14 | | |
| | | DE | FF | | |
| | | DF | 00 | | |

DATA TABLE

| ADD'R | DATA |
|---|---|
| 70 | 01 |
| 71 | FF |
| 72 | 9F |
| 73 | FF |
| 74 | 00 |
| 75 | 7F |
| 76 | 02 |
| 77 | 21 |
| 78 | 00 |
| 79 | 00 |
| 7A | 28 |
| 7B | 06 |
| 7C | 28 |
| 7D | FD |
| 7E | OA |
| 7F | 02 |
| 80 | 00 |
| BB | OF |
| BC | OF |
| BD | FA |
| BE | OF |
| BF | 06 |
| CO | OF |
| C1 | FA |
| C2 | 10 |
| C3 | 05 |
| C4 | 10 |
| C5 | FC |
| C6 | 10 |
| C7 | 03 |
| C8 | 10 |
| C9 | FE |
| CA | 10 |
| CB | 01 |
| CC | 10 |

-continued

APPENDIX II

| | |
|---|---|
| CD | FF |
| CE | 00 |
| CF | 11 |
| DO | OF |
| D1 | 17 |
| D2 | F7 |
| D3 | 14 |
| D4 | 09 |
| D5 | 14 |
| D6 | F6 |
| D7 | 14 |
| D8 | 04 |

APPENDIX III

RESISTORS

| | | | |
|---|---|---|---|
| 26A | 10 K ohm | 58L | 330 ohm |
| 26B | 100 K ohm | 60B | 56 K ohm |
| 28B | 39 K ohm | 60E | 10 K ohm |
| 28C | 27 K ohm | 60F | 560 K ohm |
| 28D | 22 K ohm | 60H | 100 K ohm |
| 28E | 68 K ohm | 60J | 330 ohm |
| 28F | 2.7 K ohm | 64B | 56 K ohm |
| 28G | 1.0 K ohm | 64F | 560 K ohm |
| 30 | 25 K ohm | 64G | 100 K ohm |
| 32D | 2.2 K ohm | 64I | 220 ohm |
| 32F | 1.5 M ohm | 102B | 3.9 K ohm |
| 32G | 2.2 M ohm | 102D | 390 K ohm |
| 34B | 10 K ohm | 102F | 390 K ohm |
| 36B | 1 K ohm | 104B | 5.1 K ohm |
| 38E | 1 K ohm | 104E | 6.3 K ohm |
| 38F | 1 K ohm | 104F | 47 K ohm |
| 38H | 330 ohm | 104G | 3.3 K ohm |
| 40 | 1 M ohm | 104H | 3.3 M ohm |
| 42 | 100 K ohm-1 M ohm | 104I | 30 K ohm |
| 56F | 100 K ohm | 106B | 10 K ohm |
| 56H | 100 K ohm | 106E | 10 K ohm |
| 58B | 56 K ohm | 106G | 20 K ohm |
| 58E | 290 K ohm | 106J | 20 K ohm |
| 58F | 25 K ohm | 106L | 10 K ohm |
| 58H | 20 K ohm | 106M | 10 K ohm |
| 58I | 20 K ohm | 108D | 10 K ohm |
| 58J | 100 K ohm | 108F | 390 K ohm |
| 108G | 10 K ohm | 126C | 120 K ohm |
| 110B | 33 K ohm | 126D | 6.8 K ohm |
| 110E | 33 K ohm | 126E | 6.2 K ohm |
| 110F | 3.3 M ohm | 128B | 5.1 K ohm |
| 110H | 390 K ohm | 128F | 47 K ohm |
| 110J | 240 K ohm | 128G | 8.2 K ohm |
| 110K | 100 K ohm | 130C | 2.7 K ohm |
| 110O | 1 M ohm | 130D | 10 K ohm |
| 110Q | 33 K ohm | 130F | 22 K ohm |
| 110R | 33 K ohm | 130I | 100 K ohm |
| 110S | 24 K ohm | 130K | 33 K ohm |
| 112L | 680 ohm | 130M | 22 ohm |
| 112M | 22 K ohm | 130N | 22 K ohm |
| 112N | 3.3 K ohm | 130Q | 100 K ohm |
| 112Q | 1 K ohm | 130S | 33 K ohm |
| 112S | 8.2 K ohm | 130U | 22 ohm |
| 112T | 8.2 K ohm | 130V | 150 K ohm |
| 112U | 1 K ohm | 132A | 2.0 K ohm |
| 112W | 100 K ohm | 132E | 2.0 K ohm |
| 114B | 220 K ohm | 134E | 10 K ohm |
| 114C | 180 ohm | 134F | 1 K ohm |
| 114E | 33 K ohm | 140B | 20 K ohm |
| 114F | 33 K ohm | 140D | 20 K ohm |
| 114G | 390 K ohm | 140G | 10 K ohm |
| 114J | 560 K ohm | 142B | 20 K ohm |
| 116D | 10 K ohm | 142D | 20 K ohm |
| 116F | 2.2 K ohm | 142G | 10 K ohm |
| 120B | 1 K ohm | 146D | 22 K ohm |
| 120C | 10 K ohm | 146G | 10 K ohm |
| 126A | 22 K ohm | 146H | 20 K ohm |
| 146I | 20 K ohm | 152G | 1 M ohm |
| 146J | 15 K ohm | 152H | 20 K ohm |
| 146K | 7.5 K ohm | 152I | 10 K ohm |
| 146L | 470 K ohm | 152J | 10 K ohm |
| 146M | 4.7 M ohm | 152K | 10 K ohm |

-continued

APPENDIX III

| | | | |
|---|---|---|---|
| 146P | 3.0 K ohm | 152L | 10 K ohm |
| 146S | 2.2 M ohm | 154B | 10 K ohm |
| 148B | 10 K ohm | 154B | 200 ohm |
| 148C | 20 K ohm | 154D | 10 K ohm |
| 148D | 22 K ohm | 154F | 10 K ohm |
| 150A | 20 K ohm | 154G | 10 K ohm |
| 150B | 20 K ohm | 154H | 180 K ohm |
| 150C | 20 K ohm | 154I | 33 K ohm |
| 150E | 20 K ohm | 156A | 20 K ohm |
| 150F | 1 M ohm | 156B | 20 K ohm |
| 150G | 10 K ohm | 156C | 20 K ohm |
| 150H | 10 K ohm | 156D | 20 K ohm |
| 150I | 10 K ohm | 156E | 20 K ohm |
| 150J | 15 K ohm | 156F | 20 K ohm |
| 150K | 10 K ohm | 156G | 20 K ohm |
| 150M | 20 K ohm | 156I | 20 K ohm |
| 150N | 54.9 K ohm | 156J | 5 K ohm |
| 150O | 10 K ohm | 156K | 10 K ohm |
| 150P | 54.9 K ohm | 156M | 20 K ohm |
| 150Q | 1.0 K ohm | 156N | 54.9 K ohm |
| 152B | 20 K ohm | 156O | 54.9 K ohm |
| 152C | 20 K ohm | 156P | 1 K ohm |
| 152D | 20 K ohm | 158B | 4.7 K ohm |
| 152G | 20 K ohm | 158C | 47 K ohm |
| 152F | 20 K ohm | 158D | 47 K ohm |
| 158G | 10 K ohm | 110D | .22 uf |
| 158H | 476 K ohm | 110N | .0068 uf |
| 158I | 10 K ohm | 110I | .22 uf |
| 158J | 10 K ohm | 110P | .1 uf |
| 160B | 10 K ohm | 112P | 1 uf |
| 180B | 150 ohm | 114H | .22 uf |
| 180D | 4.7 K ohm | 116E | .22 uf |
| 180E | 78 K ohm | 128A | 4.7 uf |
| 180F | 10 K ohm | 130E | 100 pf |
| 180H | 4.7 K ohm | 130L | 1 uf |
| 180I | 100 ohm | 130T | 1 uf |
| 180K | 4.7 K ohm | 146B | 1000 pf |
| 180L | 100 ohm | 146C | 1000 pf |
| 180M | 2.2 K ohm | 146R | 100 pf |
| 180O | 4.7 K ohm | 154C | 1000 pf |
| 180P | 100 ohm | 154K | 4.7 uf |
| 180Q | 1.3 K ohm | 160C | 10 uf |

| CAPACITORS | | AMPLIFIERS | |
|---|---|---|---|
| 32C | 330 pf | All 4558 except: | |
| 32E | 0.1 uf | 1460 | CA3140 |
| 38D | 2.2 uf | 148F | CA3140 |
| 56E | 3.3 uf | 158A | CA3080A |
| 56I | 3.3 uf | 114A | LM339 |
| 64E | 0.05 uf | 114D | LM339 |
| 102A | 0.1 uf | 110A | LM339 |
| 102E | 33 pf | 110G | LM339 |
| 102G | 0.1 uf | 110M | LM339 |
| 106C | 6800 pf | 110N | LM339 |
| 108I | .22 uf | Analog switches DG201 or 4066 | |
| 110C | 1.0 uf | LED Transistors CA3086 | |

I claim:

1. In a music synthesizer having means for generating a first voltage manifesting the frequency of an input signal, first voltage controlled oscillator means for responding to said first voltage by providing a signal having a first frequency related to said first voltage, the improvement comprising:

means for programming said synthesizer to provide a programmed voltage;

second voltage controlled oscillator means which responds to a second voltage applied thereto for providing a signal having a second frequency related to said second voltage, said second voltage being related to said first voltage less said programmed voltage;

means for connecting a modulating signal having said first frequency to said second voltage controlled oscillator means to frequency modulate said second voltage controlled oscillator means signal; and means for combining said first and second voltage controlled oscillator means signals as a synthesizer output signal.

2. The invention according to claim 1 wherein said modulating signal is a triangle wave.

3. The invention according to claim 1 wherein said programmed voltage is equal to said first voltage at the time said synthesizer is programmed, less an offset voltage.

4. The invention according to claim 3 wherein said offset voltage is equal in magnitude to a voltage to cause said second oscillator means to provide a signal at a reference frequency.

5. The invention according to claim 1 wherein said second voltage is related to said first voltage less the difference between said programmed voltage and a reference voltage, said reference voltage being that which if applied to said second voltage controlled oscillator would cause a signal to be provided having a reference frequency.

6. The invention according to claim 5 wherein said modulating signal is provided by said first oscillator means.

7. The invention according to claim 6 wherein said modulating signal is a triangle wave.

8. The invention according to claim 7 wherein said means for connecting includes switch means for being controlled to switchably connect said modulating signal.

9. The invention according to claim 8 wherein said means for connecting further can be controlled to switchably connect a signal having said first frequency to said second oscillator means to synchronize said second oscillator means with said first frequency, whereby said second oscillator means signal occurs at a multiple of said first frequency.

10. The invention according to claim 9 wherein said synchronizing signal is a pulse signal.

11. The invention according to claim 10 wherein said synchronizing signal is provided by said first oscillator means.

12. The invention according to claim 11 wherein said switch means can be controlled to connect only one of said modulating signal or said synchronizing signal to said second oscillator means at any given time.

13. The invention according to claim 12 wherein said switch means can be controlled to connect neither said modulating nor said synchronizing signals to said second oscillator means.

14. The invention according to claim 1 wherein said means for connecting includes switch means for being controlled to switchably connect said modulating signal.

15. The invention according to claim 14 wherein said means for connecting further can be controlled to switchably connect a signal having said first frequency to said second oscillator means to synchronize said second oscillator means with said first frequency, whereby said second oscillator means signal occurs at a multiple of said first frequency.

16. The invention according to claim 15 wherein said synchronizing signal is a pulse signal.

17. The invention according to claim 16 wherein said synchronizing signal is provided by said first oscillator means.

18. The invention according to claim 17 wherein said switch means can be controlled to connect only one of said modulating signal or said synchronizing signal to said second oscillator means at any given time.

19. The invention according to claim 18 wherein said switch means can be controlled to connect neither said modulating nor said synchronizing signals to said second oscillator means.

* * * * *